US005981129A

United States Patent [19]

Akazawa et al.

[11] Patent Number: 5,981,129

[45] Date of Patent: Nov. 9, 1999

[54] ELECTROPHOTOGRAPHIC TONER AND METHOD OF MANUFACTURING SAME

[75] Inventors: Yoshiaki Akazawa, Osaka; Toshihiko Murakami, Kashiba; Tatuo Imafuku, Nara; Takeaki Ohuchi, Shiki-gun; Yasuharu Morinishi, Tenri; Satoshi Ogawa, Yamatokoriyama; Tadashi Nakamura, Nara; Hitoshi Nagahama, Uji; Toshihisa Ishida, Kashiba, all of Japan

[73] Assignee: Sharp Kabushiki Kaisha, Osaka, Japan

[21] Appl. No.: 09/025,113

[22] Filed: Feb. 17, 1998

[30] Foreign Application Priority Data

| | | | |
|---|---|---|---|
| Feb. 20, 1997 | [JP] | Japan | 9-036742 |
| Jul. 23, 1997 | [JP] | Japan | 9-197590 |
| Aug. 29, 1997 | [JP] | Japan | 9-235167 |

[51] Int. Cl.[6] ..... G03G 9/093

[52] U.S. Cl. ..... 430/110; 430/137

[58] Field of Search ..... 430/137, 106, 430/110

[56] References Cited

U.S. PATENT DOCUMENTS

| | | | |
|---|---|---|---|
| 3,967,962 | 7/1976 | O'Malley | 96/15 D |
| 4,345,013 | 8/1982 | Diamond et al. | 430/106.6 |
| 4,528,257 | 7/1985 | Polderman et al. | 430/109 |
| 4,980,257 | 12/1990 | Anno et al. | 430/110 |
| 5,206,109 | 4/1993 | Anno | 430/137 |
| 5,219,697 | 6/1993 | Mori et al. | 430/110 |
| 5,350,657 | 9/1994 | Anno et al. | 430/111 |
| 5,849,456 | 12/1998 | Matsumura | 430/137 |

FOREIGN PATENT DOCUMENTS

| | | |
|---|---|---|
| 0 488 789 A1 | 6/1992 | European Pat. Off. . |
| 1-17576 B2 | 3/1989 | Japan . |
| 1-257854 | 10/1989 | Japan . |
| 1-257856 | 10/1989 | Japan . |
| 2-40950 | 2/1990 | Japan . |
| 2-93545 | 4/1990 | Japan . |
| 4-335357 | 11/1992 | Japan . |
| 5-34971 | 2/1993 | Japan . |
| 5-56502 B2 | 8/1993 | Japan . |
| 1 449 363 | 9/1976 | United Kingdom . |

*Primary Examiner*—John Goodrow

*Attorney, Agent, or Firm*—David G. Conlin; George W. Neuner

[57] ABSTRACT

An electrophotographic toner is made up of toner particles composed of irregularly-shaped core particles made chiefly of binder resin, and surface-modifying fine particles which are first dispersed over and attached to the surface of the core particles, and then affixed or formed into a film thereon. The BET specific surface area, based on $N_2$ adsorption, of the toner particles is less than 0.64 times the BET specific surface area of the core particles and surface-modifying fine particles combined together. Further, this value is 1.07 times the BET specific surface area of hypothetical toner particles which are perfect spheres. Consequently, the toner is not prone to problems such as filming, toner scattering, and fogging which are caused by peeling, separation, etc. of the surface-modifying fine particles, nor to poor cleaning due to spherical toner particles. Further, since the toner is manufactured with a quantitative grasp of the state of modification of the surface of the core particles by the surface-modifying fine particles, it is a toner in a stable state.

29 Claims, 4 Drawing Sheets

ELECTROPHOTOGRAPHIC TONER AND METHOD OF MANUFACTURING SAME

FIELD OF THE INVENTION

The present invention concerns an electrophotographic toner which has undergone surface modification processing, for use in one-component or two-component developing agents used to develop electric or magnetic latent images in image-forming devices, such as copy machines and printers, which adopt the electrophotographic method, and concerns a method of manufacturing this electrophotographic toner.

BACKGROUND OF THE INVENTION

In image-forming devices, such as copy machines and printers, which use the electrophotographic method, images are generally formed as follows. First, toner having a positive or negative charge is electrostatically affixed to an electrostatic latent image formed on a photoconductive member (photoreceptor), so as to form a toner image. Then, this toner image is transferred to and fixed on a transfer material such as transfer paper.

Toners used for this kind of image formation generally have an average particle diameter of 5 μm to 20 μm, and generally include at least a colorant and a binder resin for fixing the colorant, etc. to the transfer material (transfer paper etc.).

In the past, various toners have been used as developing agents for developing latent images formed on photoreceptors in electrophotographic image-forming devices. One conventional method of manufacturing toner is, for example, grinding. This is a manufacturing method in which materials such as colorant, charge control agent, and anti-offset agent (mold release agent) are melted and kneaded together with a thermoplastic resin.

This mixture is then cooled and hardened, and then ground and separated to produce toner particles.

Another method is suspension polymerization, in which materials such as charge control agent are mixed and dispersed with polymerizable monomers, polymerization initiator, colorant, etc. This mixture is then polymerized in water. Again, there are wet methods such as the suspension granulation method, in which a colorant and a charge control agent are added to a synthetic resin. This mixture is then melted, suspended in a non-solvent medium, and granulated.

However, with toner produced by these manufacturing methods, the charge control agent, anti-offset agent, etc. exists within the toner particles. Further, only a small amount of these additives exists on the surface of the toner particles. For this reason, the charging quantity of the toner shows a wide distribution, and accordingly there are problems with toner scattering and image fogging. There are also cases when sufficient anti-offset effect cannot be obtained.

Further, the charging quantity of the toner is generally controlled by a friction charging member such as a carrier or a charging blade. If the charging quantity is more than the optimum quantity, image density is too low, but if it is less than the optimum quantity, fogging, toner scattering, etc. occur, leading to deterioration of image quality.

In order to prevent these kinds of problems, a charge control agent is generally internally added to the toner. For example, charge control agents added to positive-charging toners include nigrosine-based dyes, pyridinium salt, ammonium salt, and lake compounds of these.

However, although these charge control agents internally added to the toner are fine particles, they have a wide particle size distribution, and have no set shape. Accordingly, control of the state of their dispersal within the particles of binder resin is difficult. For example, if the particles of charge control agent dispersed within the binder resin particles are too large in diameter, the charge control agent is likely to separate out during successive copying, dirtying the charging member (carrier etc.). Again, if the particles of charge control agent dispersed within the binder resin particles are too small in diameter, their charge controlling effect is weakened. This has the drawback that the supplied toner has a slow charging response, giving rise to image fogging, toner scattering, etc.

Further, the proportion of internally added charge control agent which is exposed on the surface of the toner particles differs according to the dispersal conditions at the time of production. Accordingly, another drawback is that the charging quantity of the toner is difficult to stabilize. In addition, it is even more difficult to control the dispersal of the charge control agent with toners formed by polymerization.

As discussed above, it is difficult to take full advantage of the effects of charge control agents, anti-offset agents, etc. if they are merely internally added to the toner.

An alternative method of controlling toner charging is a technique for applying mechanical impact force, using a particle surface modification device, to attach to the surface of the toner particles chargeable inorganic particles made of a material such as silica, alumina, or titanium oxide, which have been surface processed with a material such as silane coupler or silicon oil.

However, in order to give the toner sufficient chargeability using these chargeable inorganic fine particles, they must be used in great quantity. Again, in order to fully attach the chargeable inorganic fine particles to the surface of the toner particles by means of mechanical impact force, attachment processing must be continued until surface unevenness of the toner particles is eliminated, even when non-spherical toner particles are used. As a result, toner particles which have undergone attachment processing become perfect spheres without points, which impairs blade cleaning and leads to poor cleaning.

In recent years, the development of high-speed copy machines, environment-responsive copy machines, etc., has created a need for development of toner capable of low-energy fixing low-temperature fixing). Accordingly, as a means of attaining low-temperature fixing, methods using toners including binder resins with low glass transition points or softening points have been investigated.

One example of a technique for attaining low-temperature fixing is Japanese Examined Patent Publication No. 36586/1982 (Tokukosho 57-36586), which discloses a toner which uses as binder resin a crystalline polymer having a melting point of 50° C. to 150° C. and an activation energy of 35 kcal/mol or less.

Further, Japanese Unexamined Patent Publication No. 87032/1975 (Tokukaisho 50-87032) (corresponding to U.S. Pat. No. 3,967,962) discloses a toner which uses a polymer formed by chemical bonding of a crystalline polymer with a melting point of 45° C. to 150° C. and a non-crystalline polymer with a glass transition point of 0° C. or lower.

Again, Japanese Unexamined Patent Publication No. 3446/1984 (Tokukaisho 59-3446) (U.S. Pat. No. 4,528,857) discloses a toner which uses a block co-polymer, in which a crystalline block, with a melting point of 50° C. to 70° C., is included in a non-crystalline block molecule with a glass transition point 10° C. higher than the melting point of the crystalline block.

However, use of these conventional low-temperature-fixing toners was difficult because of such problems as toner filming phenomenon caused by the soft portion of polymers, deterioration of toner chargeability, photoreceptor characteristics, etc. in, for example, successive copying, and blocking phenomenon. In other words, attaining low-temperature fixing by using toners with low glass transition points or softening points had serious problems such as deterioration of the toner's resistance to blocking, not to mention filming phenomenon and offset phenomenon.

For this reason, in the past, a method of adding an external additive to prevent deterioration of the toner's resistance to blocking has been adopted.

However, if this external additive is not attached to the toner particles but can move freely, it moves from the toner to the carrier when the carrier and toner are mixed, thus changing the quantity of charging, etc. As a result, the toner's stability over time (toner life during successive copying) deteriorates, which leads to impairment of image quality.

In recent years, the electrophotographic process has been adopted in various fields such as printers, facsimiles, color copy machines, and high-speed copy machines, and thus toners are needed which combine various characteristics (such as control of charge polarity) corresponding to these various fields and functions.

In response to this need, numerous electrophotographic toners of a type called "surface-modified toner," which gives the electrophotographic toner various characteristics, are being investigated. Some examples of surface-modified toners are a toner to which are added fine particles having various functions, such as charge control agent; an electrophotographic toner in which durability, fixing characteristics, etc. are improved by using fine particles of hardened resin to cover the surface of core particles having a low softening point; and a toner which improves charging characteristics, fluidity characteristics, etc. by means of processing to make the toner particles spherical.

In particular, many surface-modified toners have been proposed in which surface-modifying fine particles of, for example, charge control agent are dispersed over and attached to the surface of core particles of colorant, and then affixed or formed into a film thereon. For example, Japanese Examined Patent Publication No. 17576/1989 (Tokukohei 1-17576) discloses an electrophotographic graphic toner in which particles of colored resin powder are covered with a layer of a fine powder of resin or polymeric material having a particle diameter of not more than 1/10 of that of the colored resin powder. This toner is formed by coverage processing until the particles of fine powder are embedded over part of the surface of each particle of colored resin, and then heating to fuse the particles of fine powder together, forming a covering on each particle of colored resin.

Again, Japanese Unexamined Patent Publication No. 3171/1992 (Tokukaihei 4-3171) (corresponding to U.S. Pat. No. 5,206,109) discloses a manufacturing method in which surface-modifying fine particles are attached to the surface of core particles, uniformly affixed thereto by application of mechanical impact force, and then uniformly fixed or turned into a film thereon by heating in a hot air flow at 200° C. to 600° C.

Again, Japanese Examined Patent Publication No. 56502/1993 (Tokukohei 5-56502) proposes a surface-modified toner in which mechanical impact force is applied to attach fine powder having various functions, 2 μm or less in average particle diameter, to the surface of particles of a binder resin powder made chiefly of binder resin. In this toner, attachment is performed by imbedding the particles of fine powder in the surface of each particle of binder resin powder, so that the thickness of the surface layer produced will be 2 μm or less, while heating at a temperature of at least 48° C., but below the melting point of the binder resin.

Japanese Unexamined Patent Publication No. 34971/1993 (Tokukaihei 5-34971) discloses the following method of manufacturing electrophotographic toner. First, in a processing room, a rotating member is rotated, mixing toner core particles (chiefly made of at least resin) with surface-processing fine particles in a high-speed air flow. By means of this mixing, the fine particles can be uniformly dispersed and attached over the surface of each toner core particle. Then, by intensifying the mixing conditions, the fine particles attached to the surface of the toner core particles are fixed and/or turned into a film thereon.

However, electrophotographic toners produced by the grinding or wet methods discussed above, which are not surface-modified toners, have the following problems.

Generally, electrophotographic toners have charging characteristics (including polarity) which vary according to the needs of the object for which and the environment in which they are to be used. In other words, different types of electrophotographic toner include different quantities of charge control agent, etc. Accordingly, when a single electrophotographic toner manufacturing device is to be used to manufacture different types of electrophotographic toner, any previously manufactured toner remaining in the manufacturing device will cause problems such as increase of the quantity of toner with reverse polarity in the subsequently manufactured toner, decrease of the toner's charging stability, etc. In order to avoid these problems, different production lines are usually provided for toners with different polarity, or thorough maintenance cleaning of the manufacturing device is performed.

Again, even with electrophotographic toners of the same polarity, according to the required characteristics, different types of charge control agents are used. The composition of toners also varies. Accordingly, even when manufacturing electrophotographic toners of the same polarity, if the same manufacturing device is to be used, thorough maintenance cleaning of the manufacturing device must be carried out, as above, in order to avoid contamination from different charge control agents or toner materials.

In this way, when manufacturing electrophotographic toners of this type, maintenance cleaning of the manufacturing device must be performed whenever the type of toner is changed. This accordingly has drawbacks such as increase in the cost of manufacturing the toner arising from the costs of cleaning and of materials discarded and wasted at the time of cleaning.

In addition, the foregoing conventional methods of manufacturing surface-modified toners merely propose methods of affixing/forming a film of surface-modifying fine particles on the surface of core particles by mechanical or heat processing, or toners produced by such methods.

These conventional manufacturing methods perform mechanical impact or heat processing to obtain a toner with long life, in which the surface-modifying fine particles on the surface of the core particles will withstand the stress of use without peeling or separation. Accordingly, the toner particles produced are made spherical, which reduces friction with the cleaning device, leading to problems such as poor cleaning.

Further, the actual state of the toner obtained by surface modification is determined only by visual means such as observing the surface of particles of surface-modified toner through an SEM (Scanning Electron Microscope). In other words, the state of the toner is not grasped quantitatively, either during or after manufacturing. Accordingly, with the conventional manufacturing methods, it is difficult to determine whether the surface-modified toner which has been manufactured sufficiently realizes desired functions. As a result, there is a great possibility that a toner will be manufactured which is not uniform and which lacks stability.

In addition, none of the conventional art gives any consideration to the weight-average molecular weight of the polymer particles (surface-modifying particles) to be affixed or made into a film on the surface of the core particles.

Incidentally, there is a method of evaluating the state of surface-modified toner produced which uses the BET specific surface area, based on $N_2$ adsorption. The BET specific surface area of surface-modifying particles to be affixed to the surface of core particles is specified in Japanese Unexamined Patent Publication No. 335357/1992 (Tokukaihei 4-335357). However, the BET specific surface area of the surface-modified toner produced is not discussed. Further, this disclosure does not hit upon the idea of quantitatively grasping the state of surface modification.

If the core particles for surface-modified toner are to be manufactured by polymerization, facilities for control of dangerous substances such as monomers and initiators, processing of waste water, etc. are necessary, which requires large investments in facilities and increases the expenses of repayment of these investments. Further, washing and drying processes take a long time, thus reducing productivity. In addition, since the fine powder cannot be reused, manufacturing costs are increased in comparison with grinding.

In addition, since in this case the electrophotographic toner particles obtained are nearly spherical, their reduced friction results in reduced attaching force. Spherical toner particles also have a negative effect on the cleaning process. This cleaning process is the removal, using a cleaning brush, etc., of untransferred toner remaining on the photoreceptor after transfer of the toner image. When the untransferred toner is spherical, it has insufficient attaching force with respect to the cleaning brush, and its removal is made difficult.

Further, in actual use of electrophotographic toner in, for example, a high-speed copy machine (copy speed of 60 sheets/minute or more), there are cases when high stress may be applied within the developer, etc. At this time, this stress may cause peeling or separation of the fine particles of charge control agent from the surface of the core particles, leading to so-called image fogging. Accordingly, in such cases, stronger affixing/film film formation of the fine particles of charge control agent on the surface of the core particles is needed.

However, this kind of stronger affixing/film formation cannot be realized with manufacturing methods in which all processing is carried out in a surface modification device such as a Henschel-type mixer. For this reason, electrophotographic toner which is to be used in a device which applies high stress thereto should preferably be manufactured using a high-energy-applying surface modification device capable of affixing/film formation by applying high shearing force, high impact force, or high energy.

However, if a high-energy-applying device is used from the stage of manufacturing at which the core particles and the fine particles of charge control agent are combined, affixing/film formation of the fine particles proceeds before the fine particles have been uniformly dispersed. As a result, the charge control particles may become affixed to the core particles in a non-uniform state, or a film of non-uniform thickness may be formed. This may lead to manufacturing of electrophotographic toner which lacks charging stability.

Conventional art has also been proposed in which functional fine particles such as charge control agent are dispersed over and attached directly to colored core particles, and then affixed and/or formed into a film thereon. However, no electrophotographic toner has been proposed in which polarity can be controlled even when using the same core particles. Further, no proposal has noted the advantages and effects which could be obtained, in manufacturing electrophotographic toner, by providing a step after production of the core particles, in which they are given a charge of the required polarity.

SUMMARY OF THE INVENTION

The present invention was created in order to solve the foregoing problems of the conventional art. Its first object is to provide a surface-modified toner capable of improving stability over time (toner life during successive copying) by preventing problems such as filming, toner scattering, and image fogging due to peeling, separation, etc. of surface-modifying fine particles made of, for example, fine polymer particles, and to prevent poor cleaning due to spherical toner particles.

Further, a second object of the present invention is to provide a toner capable of low-temperature fixing, and which has superior heat resistance, i.e., storage stability (anti-blocking) characteristics.

Further, a third object of the present invention is to provide a method of manufacturing electrophotographic toner which does not require provision of separate production lines for each type of electrophotographic toner to be manufactured, and which, when different types of electrophotographic toner are to be manufactured on the same production line, does not require thorough maintenance cleaning whenever the type of toner is changed.

In order to attain the first object mentioned above, an electrophotographic toner according to the present invention is made up of irregularly-shaped core particles chiefly composed of binder resin, and surface-modifying fine particles which are first dispersed over and attached to the surface of the core particles, and then affixed or made into a film thereon, so as to produce toner particles, in which:

the BET specific surface area, based on $N_2$ adsorption, of the toner particles satisfies:

$$0.64S_0>S>1.07\times[3/(\rho D/2)]; \text{ and}$$

$$S_0=S_1X+S_2(1-X),$$

where:

S is the BET specific surface area of the toner particles;

$S_0$ is the BET specific surface area of the core particles and the surface-modifying fine particles combined together;

$S_1$ is the BET specific surface area of the core particles alone;

$S_2$ is the BET specific surface area of the surface-modifying fine particles alone;

ρ is the specific gravity of the toner particles;

D is the average particle diameter of the toner particles by volume; and

X is the ratio of composition of the surface-modifying modifying fine particles based on a weight standard.

With the foregoing structure, the toner's BET specific surface area is less than $0.64S_0$; in other words, the surface-modifying fine particles are sufficiently affixed to the surface of the core particles, and thus problems like filming and toner scattering will not occur. Further, the toner's BET specific surface area is more than 1.07 times that of hypothetical toner particles which are perfect spheres; in other words, the toner particles are not spherical, and thus poor cleaning can be prevented.

As a result, a surface-modified toner can be obtained in which the surface-modifying fine particles dispersed over and attached to the surface of the core particles are affixed or made into a film thereon strongly enough so that they will not peel or separate therefrom, but without producing spherical toner particles, thus avoiding problems such as poor cleaning.

In order to attain the second object mentioned above, another electrophotographic toner according to the present invention is made up of core particles which include a binder resin, and fine polymer particles affixed or made into a film on the surface of the core particles, in which:

the fine polymer particles have a weight-average molecular weight within a range from 30,000 through 800,000;

the fine polymer particles have a glass transition point which is higher than that of the core particles, the core particles having a glass transition point within a range from 40° C. through 65° C., and the fine polymer particles having a glass transition point within a range from 58° C. through 100° C.; and the toner is obtained by dispersing and attaching the fine polymer particles on the surface of the core particles, followed by heat processing by exposure to a hot air flow of 150° C. to 400° C.

With the foregoing structure, since the weight-average molecular weight of the fine polymer particles is adjusted to within a range from 30,000 through 800,000, the polymer shell which protects the core particles will be sufficiently strong, and the fine polymer particles and the core particles will have superior compatibility. As a result, affixing or forming a film of the fine polymer particles does not make the irregularly-shaped core particles; spherical, and fusing the fine polymer particles and the core particles can form a strong film on the surface of the core particles.

In addition, since the foregoing electrophotographic toner is obtained by exposure to a hot air flow of 150° C. to 400° C. after the fine polymer particles have been dispersed over and attached to the surface of the core particles, the fine polymer particles and the core particles are sufficiently fused without making the irregularly-shaped core particles spherical.

As a result, problems such as filming, toner scattering, and image fogging, which are caused by peeling, separation, etc. of the fine polymer particles due to, for example, mechanical stress in the developing vessel during successive copying, can be prevented. Thus stability over time (toner life during successive copying) can be improved. Further, poor cleaning due to spherical toner particles can also be prevented.

In addition, since the glass transition point of the fine polymer particles is higher than that of the core particles, the glass transition point of the core particles being 40° C. to 65° C., and that of the fine polymer particles being 58° C. to 100° C., the foregoing electrophotographic toner enables low-temperature fixing (low-energy fixing), and has superior heat resistance, i.e., storage stability (anti-blocking) characteristics.

In order to attain the third object mentioned above, a method of manufacturing electrophotographic toner according to the present invention includes the steps of: (a) producing core particles for electrophotographic toner; and (b) using dry processing to attach fine particles to the surface of the core particles, and then to affix or form the fine particles into a film thereon; in which electrophotographic toners with different properties may be prepared by producing core particles having a common composition and by means of a common process, but changing the type or composition of the fine particles.

With the foregoing method, even when manufacturing different types of electrophotographic toners, a single production line for the core particles is sufficient, after which the fine particle affixing step (b) may be performed by means of simple dry processing. Accordingly, there is no need to provide separate electrophotographic toner production lines for electrophotographic toners with different properties. Accordingly, investment in facilities may be reduced.

Further, since the fine particle affixing step (b) is simple dry processing, there is little contamination of the interior of the manufacturing device. Accordingly, even when manufacturing different types of electrophotographic toner on the same electrophotographic toner production line, it is not necessary to perform thorough maintenance cleaning in order to remove previously manufactured electrophotographic toner remaining in the manufacturing device. In addition, the quantity of electrophotographic toner discarded at the time of cleaning can be reduced to a minimum. Accordingly, manufacturing costs of the electrophotographic toner can also be reduced.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is an explanatory drawing showing the form of a combined particle made of the core particle and surface-modifying fine particles shown in FIG. 1(*a*).

FIG. 1(*c*) is an explanatory drawing showing change in the state of surface modification of the combined particle shown in FIG. 1(*b*) in accordance with hot air temperature.

DESCRIPTION OF THE EMBODIMENTS

[First Embodiment]

The first embodiment of the present invention will be explained below.

Figure 2:
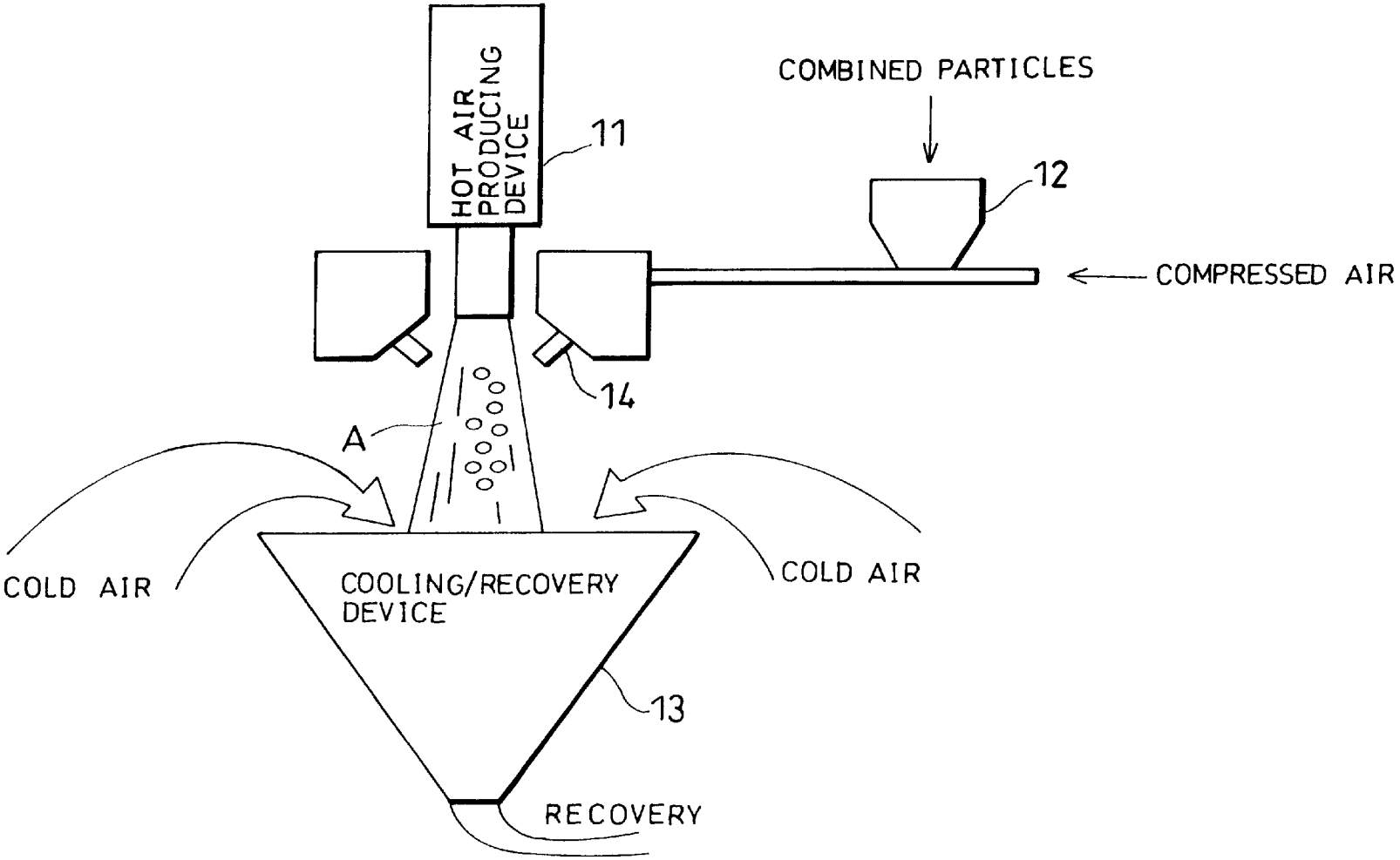
FIG. 2 is an explanatory drawing showing a heat processing device for manufacturing electrophotographic toner according to the first through third embodiments of the present invention.

As shown in FIG. 2, a heat processing device for manufacturing a surface-modified electrophotographic toner (hereinafter referred to simply as "toner") according to the present embodiment includes a hot air producing device 11, a fixed quantity supplier 12, a cooling/recovery device 13, and a diffusion nozzle 14.

The following will explain the manufacture of toner using this heat processing device.

Figure 1A:
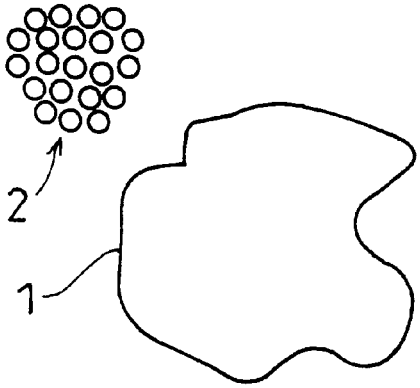
FIG. 1(*a*) is an explanatory drawing showing the form of a core particle and surface-modifying fine particles which make up an electrophotographic toner according to the first and second embodiments of the present invention.
Figure 1B:
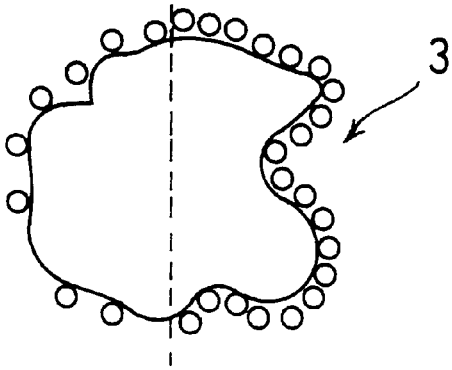
Figure 1C:
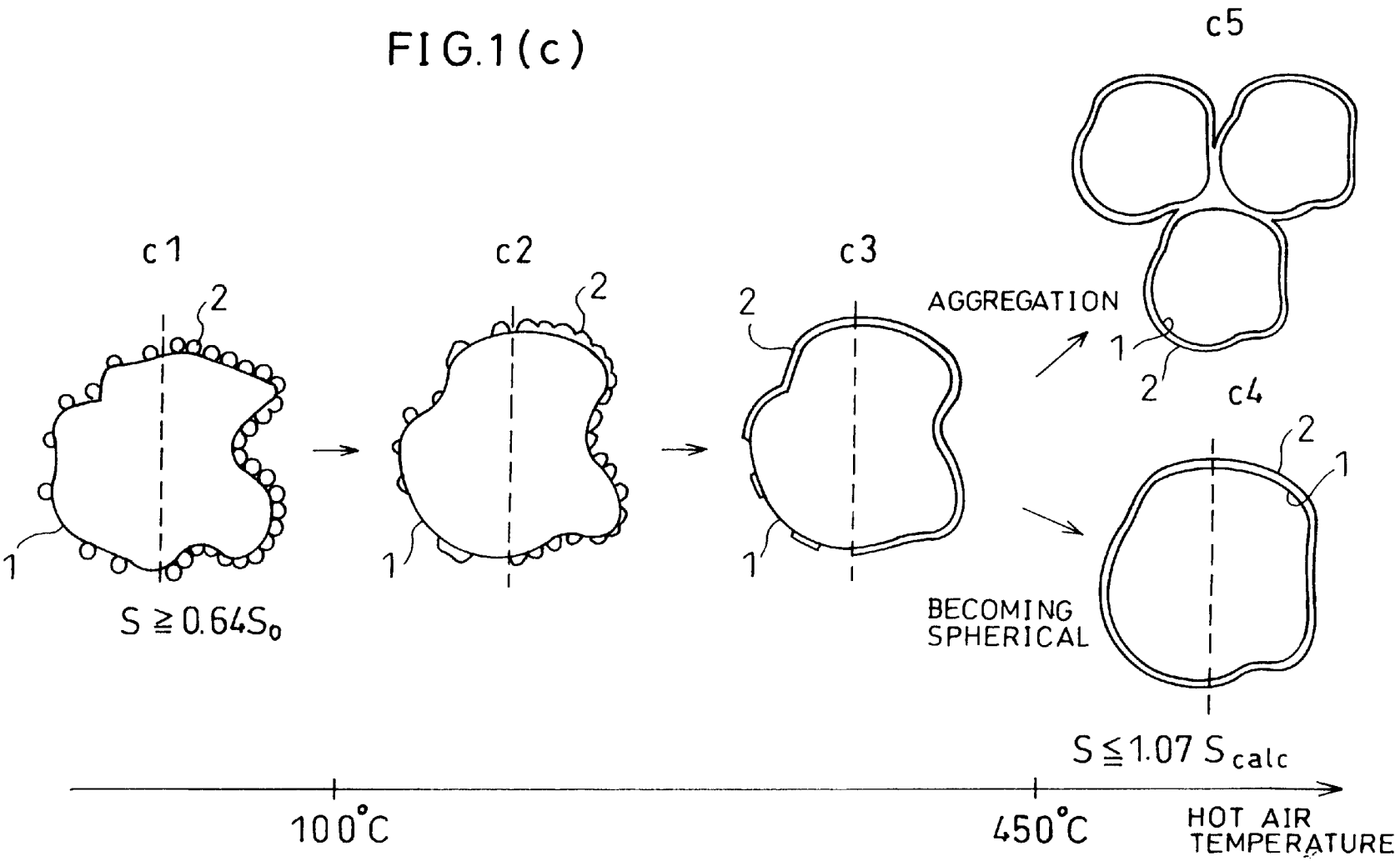

FIG. 1(*a*) is an explanatory drawing showing the form of a core particle 1 and surface-modifying fine particles 2. The core particle 1 is composed chiefly of binder resin, is irregularly shaped, and is obtained by a method such as grinding. Incidentally, "irregular shape" means any shape other than a perfect sphere.

First, the core particle 1 and the surface-modifying fine particles 2, which, as shown in FIG. 1(*a*), initially exist separately, are combined by attaching the surface-modifying fine particles 2 to the surface of the core particle 1, forming a combined particle 3. The form of the combined particle 3 is shown in FIG. 1(*b*). Then, a predetermined quantity of combined particles 3, in which the surface-modifying fine particles 2 are uniformly dispersed over the surface of the core particles 1, are supplied to the fixed quantity supplier 12 shown in FIG. 2.

Next, the combined particles 3 are sprayed, along with compressed air, from the fixed quantity supplier 12 through the diffusion nozzle 14 and into a hot air flow area A. The hot air flow area A is hot air produced by the hot air producing device 11, the temperature of which is adjusted to a predetermined level. In the hot air flow area A, heat energy is instantly applied to the combined particles 3.

Then, in order to affix or form a film of the surface-modifying fine particles 2 on the surface of the core particles 1, the combined particles 3, to which the heat energy has been applied, are guided into the cooling/recovery device 13 and immediately cooled by cold air. This cold air may be external air of normal temperature (approximately 25° C.), or cooled air of adjusted temperature.

Toner particles of a predetermined state, which have undergone surface modification in a heat processing device of this kind, are recovered at a temperature lower than the glass transition point of the chief resin of the core particles, and turned into commercial products.

At this time, the surface-modified toner is manufactured Do that the BET specific surface area, based on $N_2$ adsorption, of the toner particles satisfies:

$$0.64S_0 > S > 1.07S_{calc} \tag{1}$$

$$S_0 = S_1 X + S_2(1 - X) \tag{2}$$

$$\begin{aligned} S_{calc} &= (\text{surface area of perfect sphere})/(\text{density} \times \text{volume of perfect sphere}) \\ &= 4\pi(D/2)^2/[\rho \times (4\pi/3) \times (D/2)^3] \\ &= 3/(\rho D/2) \end{aligned} \tag{3}$$

Here,

S is the BET specific surface area of the toner particles;

$S_0$ is the BET specific surface area of the core particles and the surface-modifying fine particles combined together;

$S_1$ is the BET specific surface area of the core particles alone;

$S_2$ is the BET specific surface area of the surface-modifying fine particles alone;

ρ is the specific gravity of the toner particles;

D is the average particle diameter of the toner particles by volume; and

X is the ratio of composition of the surface-modifying fine particles based on a weight standard.

Incidentally, the average particle diameter by volume is particle diameter based on a mass standard. The BET specific surface area based on N2 adsorption is the surface area per unit mass of a powder, which is calculated from the volume of nitrogen ($N_2$) adsorbed by the powder by using the BET adsorption isotherm.

It is preferable if the BET specific surface area of the toner particles is as shown by:

$$0.60\ S_0 \geqq S \geqq 1.10\ S_{calc} \tag{4}$$

Further, it is even more preferable if the toner's BET specific surface area is as shown by:

$$0.38\ S_0 \geqq S \geqq 1.12\ S_{calc} \tag{5}$$

Appropriate control of the various operating parameters of the manufacturing process is sufficient to ensure that the toner satisfies the conditions of equations (1), (4), and (5). These parameters include, for example, device conditions such as the quantity of combined particles processed, the temperature of the hot air produced by the hot air producing device 11, the duration of exposure of the combined particles in the hot air flow area A, the angle of the diffusion nozzle 14, and the rate of flow ratio (proportion of speed of particles to speed of hot air flow), and the composition, combination ratio, particle diameter, shape (chiefly the core particles), glass transition point, and molecular weight of the core particles and surface-modifying fine particles.

In equations (1), (4), and (5), the value on the left side shows the extent of surface modification based on the extent of fusing of the surface-modifying fine particles, the way heat is applied, etc., and the value on the right side shows the extent to which the toner particles are made spherical (including surface smoothness). Accordingly, with this manufacturing method, the extent to which the toner particles are made spherical can be quantitatively grasped by means of the BET specific surface area based on $N_2$ adsorption, allowing control of the state of surface modification in order to manufacture a uniform and stable toner.

Further, in the foregoing heat processing device, when affixing or forming a film of the surface-modifying fine particles on the surface of the core particles, heat is applied to the surface of the combined particles instantly (no more than 1 second) using hot air more than 100° C. but less than 450° C. in temperature, or more preferably 150° C. to 400° C. By this means, a temperature above the softening point of the surface-modifying fine particles and the core particles is applied to the surface-modifying fine particles and the surface of the core particles, but a heat quantity sufficient to soften the core particles does not reach their interior.

For this reason, as shown in FIG. 1(*c*) at c2 and c3, it is possible to create a state in which the surface-modifying fine particles are fused and affixed or formed into a film on the surface of the core particle, but the irregular shape of the core particle is maintained.

Incidentally, in FIG. 1(*c*), the portion to the left of each broken line shows the state of affixing, in which the surface-modifying fine particles are affixed over part of the core particle. The portion to the right of each broken line shows the state of film formation, in which the surface-modifying fine particles are formed into a film covering the entire surface of the core particle.

However, in the heat processing mentioned above, if the temperature of the hot air is less than 100° C., heat energy sufficient to affix or form a film of the surface-modifying fine particles cannot be applied (see FIG. 1(*c*) at c1). Again, if the temperature of the hot air is more than 450° C., the core particles become more spherical (see c4), and mutual fusing and aggregation of the toner particles during surface modification occurs (see c5), sometimes making it impossible to obtain toner with a predetermined particle diameter. If processing speed is slowed in order to avoid this, problems arise, such as reduction of production efficiency and increase of production costs.

In manufacturing the toner, in order to obtain the initial state of attachment, combination, and dispersal, a device such as the Mechano-mill (Okada Precision Industries Co., Ltd. product), the Mechanofusion System (Hosokawa Micron Co., Ltd. product), the Hybridization System (Nara Machinery Manufacturing Co., Ltd. product), or the Cosmos System (Kawasaki Heavy Industries Co., Ltd. product) may be used. Again, as a heat processing device, a device able to produce a hot air flow, such as the Suffusing System (Japan Pneumatic Industries Co., Ltd. product), may be used.

A suitable state of the toner which satisfies equation (1) is a state in which the surface-modifying fine particles, are attached and affixed or formed into a film on the surface of the core particles in such a way that the following toner particles (see FIG. 1(*c*) at c2 and c3) are produced. Namely, the toner particles produced have a BET specific surface area, based on $N_2$ adsorption, which is less than 0.64 times the BET specific surface area ($S_0$) of the combined core particles and surface-modifying fine particles (which is calculated from the BET specific surface area ($S_1$) of the core particles alone, the BET specific surface area ($S_2$) of the surface-modifying fine particles alone, and the ratio of composition between the two kinds of particles), but is more than 1.07 times the BET specific surface area ($S_{calc}$) of hypothetical toner particles which are perfect spheres (which is calculated from the average particle diameter by volume of the toner produced). Further, it is more preferable if the toner particles produced also satisfy equations (4) and (5).

When image formation is performed using a toner obtained in this way, there is no occurrence of phenomena such as filming, which is caused by surface-modifying fine particles peeling or separating from the core particles and becoming attached to the photoreceptor, or toner scattering and image fogging, which are caused by free toner particles. Accordingly, stable images can be obtained.

Further, in order to obtain a toner which will not cause poor cleaning at the time of use, the toner must be manufactured giving consideration to a balance between (i) the extent to which the core particles are made spherical in surface modification processing and (ii) the extent to which the surface-modifying fine particles are affixed or formed into a film. Consideration may be given to this balance by using the BET specific surface area discussed above to control the conditions of manufacturing the toner, which is obtained by affixing or forming a film of the surface-modifying fine particles on the core particles.

However, with toner particles in a state (see FIG. 1(*c*) at c1) in which the BET specific surface area is more than the value on the left side of equation (1), i.e., more than 0.64 $S_0$, the surface-modifying fine particles will be insufficiently affixed. Accordingly, with particles in this state, separation, peeling, etc. of the surface-modifying fine particles occurs, causing such problems as filming and toner scattering. Again, with toner particles in a state (see FIG. 1(*c*) at c4 and c5) in which the BET specific surface area is less than the value on the right side of equation (1), i.e., less than 1.07 $S_{calc}$, poor cleaning arises due to the detrimental effects of spherical toner particles, and image fogging occurs due to mutual fusing and aggregation of the toner particles.

The binder resin used for the core particles of the toner may be, for example, polystyrene, styrene-acrylic copolymer, styrene-acrylonitryl copolymer, styrene-maleic anhydride copolymer, styrene-acrylic-maleic anhydride copolymer, polyvinyl chloride, poly-olefin resin, epoxy resin, silicone resin, polyamide resin, polyurethane resin, urethane-modified polyester resin, or acrylic resin, or a mixture of any of these, or a block copolymer or graft copolymer combining any of these. For binder resin, all materials may be used which have a molecular weight distribution well-known for use in toner, such as one-peak or two-peak distribution.

Further, one or more well-known function-imparting agent may be mixed and dispersed into the binder resin forming the core particles. These function-imparting agents include, but are not limited to, charge control agents like azo-based dye, carboxylic acid metal complexes, quaternary ammonium compounds, and nigrosine-based dye; colorants like carbon black, iron black, nigrosine, benzine yellow, and phthalocyanine blue; and anti-offset agents like polyethylene, polypropylene, and ethylene-propylene copolymers. Further, magnetic powder may also be included.

The core particles should preferably have heat characteristics whereby their glass transition point ($Tg_1$) is from 40° C. to 70° C. By this means, low-temperature fixing of the toner can be improved. In contrast, core particles having a glass transition point of less than 40° C. will easily melt when undergoing heat processing at over 150° C., thus becoming spherical. Accordingly, poor cleaning will arise in actual use. Again, with core particles having a glass transition point of more than 70° C., the toner produced will not melt sufficiently when being fused and fixed onto the paper in regular heat fixing. Since adhesion to the paper is impaired in this way, the image is likely to peel or rub off on surfaces it touches, because strong fixing cannot be obtained. Further, since the surface of the core particles is covered with surface-modifying fine particles having an even higher glass transition point, such a toner is not suitable for actual use.

A core particle diameter similar to that of typical powdered toners is suitable. An average particle diameter by volume of 5 $\mu$m to 15 $\mu$m is appropriate.

As surface-modifying fine particles to be attached to and affixed or formed into a film on the core particles, charge control agent, fluidizing agent, and/or colorant may be used. Again, organic fine particles and/or magnetic or non-magnetic inorganic fine particles intended to impart functions, such as anti-offset agent, may also be used. Examples of such inorganic fine particles include titanium and silicon. In particular, when thermoplastic organic fine particles are used, the foregoing toner manufacturing method, which is characterized by heat processing, can be made even more effective.

Concrete examples of thermoplastic inorganic fine particles (inorganic surface-modifying fine particles) which may be used include methyl acrylate, ethyl acrylate, butyl acrylate, methyl methacrylate, ethyl methacrylate, butyl methacrylate, and homopolymers or copolymers made of monomers such as styrene, p-methyl styrene, sodium styrensulfonate, vinyl benzyl chloride, acrylic acid, dimethyl aminoethyl acrylate, methacrylic acid, and dimethyl aminoethyl methacrylate.

Further, examples of polymerization initiators which may be used in polymerization to give the thermoplastic organic fine particles a positive or negative charging function include potassium persulfate, ammonium persulfate, and amidinopropane-base, or a monomer having a polar group such as an amino group, an amide group, a carboxylic acid group, or a sulfonic acid group.

Further, examples of substances which may be used to give the thermoplastic organic fine particles an anti-offset effect include polyethylene, polypropylene, ethylene-propylene copolymer, ethylene-vinyl acetate copolymer, ethylene-ethylacrylate copolymer, and an ionomer having a polyethylene structure.

It is especially preferable if the thermoplastic organic fine particles have an average particle diameter by volume of no more than 1 μm. This is because, when combining the core particles and surface-modifying fine particles, uniform dispersal of the surface-modifying fine particles over the surface of the core particles is preferable in order to obtain good surface modification. If the surface-modifying fine particles are too large, dispersal and attachment of the surface-modifying fine particles over the surface of the core particles becomes difficult.

In other words, if dispersal, attachment, and combination processing is performed using surface-modifying fine particles having an average particle diameter by volume of more than 1 μm, it may be impossible to attach them to the surface of the core particles using weak forces such as electrostatic force and van der Waals force, and they may exist separately from the core particles. Further, in this case, since the layer of surface-modifying fine particles is thicker, instantaneous heat processing at 150° C. to 400° C. for 1 second or less does not result in the application of sufficient heat energy to the combined particles. This may make it impossible to sufficiently fuse and affix the surface-modifying fine particles to the core particles.

Raising the temperature of heat processing in consideration of the foregoing makes the core particles spherical, and thus is not preferable. Accordingly, by selecting surface-modifying fine particles with an average particle diameter by volume of 1 μm or less, strong affixing or film formation, which is more resistant to stress, can be obtained. As a result, a good surface-modified toner can be obtained which is free of peeling or separation during use, and which does not cause poor cleaning.

The thermoplastic organic fine particles should preferably have heat characteristics whereby their glass transition point ($Tg_2$) is higher than that of the core particles ($Tg_1$), and within a range from 60° C. to 100° C. If the glass transition point is higher than 100° C., heat processing at 150° C. to 400° C. for 1 second or less will not result in the application of sufficient heat energy. Accordingly, sufficient fusing and attachment is not possible. Further, if more heat energy than this is applied, the core particles become spherical, which may lead to problems such as toner scattering and filming.

Again, if the glass transition point of the thermoplastic organic fine particles is less than 60° C., the toner produced will have poor preservation (stability in storage), and will be prone to mutual fusing and aggregation of toner particles. Further, the surface-modifying fine particles themselves, being brittle, will have inferior durability, making the toner unsuitable for actual use.

The thermoplastic organic fine particles should preferably have heat characteristics whereby their weight-average molecular weight (Mw) is from 50,000 to 210,000. If the weight-average molecular weight is more than 210,000, instantaneous heat processing at 150° C. to 400° C. for 1 second or less will not result in the application of sufficient heat energy. This may make it impossible to sufficiently fuse and affix the surface-modifying fine particles to the core particles. If the heat energy is increased in order to fuse and affix the surface-modifying fine particles, the core particles become spherical, leading to problems such as toner scattering and filming.

Again, if the weight-average molecular weight of the thermoplastic organic fine particles is less than 50,000, the toner produced will have inferior preservation (stability in storage), and the toner particles may mutually fuse or aggregate. Further, the surface-modifying fine particles themselves, being brittle, will have inferior durability, and the strength of the image formed will be impaired. By selecting surface-modifying fine particles with a weight-average molecular weight within the range specified above, a strong state of affixing or film formation, which is more resistant to stress, can be obtained, and thus a superior toner can be obtained which is free of peeling or separation during use, and which does not cause poor cleaning.

With toner in which surface-modifying fine particles are first dispersed over and attached to, and then affixed or formed into a film on, core particles, the strength of attachment of the surface-modifying fine particles varies according to the compatibility between the affixed or filmed surface-modifying fine particles and the surface of the core particles. For example, with a combination such as water and oil, even if a film is formed, the fusing force at the interface between the two kinds of particles is weak, and the film will peel at the application of the slightest stress. Accordingly, by selecting a combination with good affinity, a toner with stronger attachment can be manufactured, which is not prone to problems in actual use such as toner scattering, image fogging, and filming. In particular, in the manufacturing method according to the present embodiment, heat processing of short duration is used to affix or form a film of the surface-modifying fine particles on the core particles without making the core particles spherical. Accordingly, compatibility of the core particles and surface-modifying fine particles (i.e., the surface characteristics between the core particles and the surface-modifying fine particles) is a more important issue than in manufacturing methods which, for example, embed the surface-modifying fine particles in the surface of the core particles by means of mechanical impact force.

One index of the compatibility of an organic high molecular material is its solubility parameter (SP) value. This SP value is the square root of a value obtained by dividing the molar vaporization energy of liquid organic high molecular material by its molar volume. SP values of from 6 to 17 are typical. High molecular materials having close SP values are generally considered to have good compatibility. For example, the following materials widely used as binder resins for toner have the following SP values: styrene-(meth) acrylic resins, 8.3 to 9.5; polyester resins, around 10.7. Again, the following materials used as organic surface-modifying fine particles have the following SP values: polymethyl methacrylate (PMMA), 8.9 to 9.5; polybutyl methacrylate (PBMA), 8.4 to 9.5. Incidentally, these ranges in SP value are due to differences in the resins' molecular weight, composition, etc., the quantity of polymerization initiator added, etc.

Here, in combining the core particles and organic surface-modifying fine particles, the two materials combined can be said to have good compatibility if the absolute value of the difference in their SP values is 2.0 or less. In this case, since strong affixing or film formation of the surface-modifying fine particles is possible, a good state, in which they will not peel or separate, can be obtained. However, with combinations in which the absolute value of the foregoing difference is more than 2.0, the surface-modifying fine particles are likely to peel or separate due to the stress of stirring within the developer, etc., causing such problems as toner scattering and filming.

After calculating the quantity of surface-modifying fine particles needed to cover the surface of a core particle from the diameter of the surface-modifying fine particles, the quantity of organic surface-modifying fine particles to be added is generally determined by the percentage of the surface of the core particles to be covered, or by the qualities of the layer of surface-modifying fine particles to be attached. In the manufacturing method according to the present embodiment, any quantity of surface-modifying fine particles able to be attached to the surface of the core particles during attachment/combination processing can be affixed or formed into a film thereon during the surface modification processing. Generally, the quantity added will be no more than 20 parts surface-modifying fine particles to 100 parts core particles by weight.

However, in the manufacturing method according to the present embodiment, it is preferable if the quantity of surface-modifying fine particles added is from 0.1 part by weight to 15 parts by weight. If less than 0.1 part by weight is added, the quantity of surface-modifying fine particles on the surface of the core particles will be too small. In this case, problems will arise, such as lack of preservation because of insufficient coverage of the surface of the core particles, loss of the effects of surface modification because the core particles easily become spherical, etc.

Again, if more than 15 parts surface-modifying fine particles by weight are added, the layer of surface-modifying fine particles on the surface of the core particles will be too thick. In this case, with the instantaneous heat processing of the manufacturing method according to the present embodiment, sufficient heat will not reach the surface of the core particles, and the fusing needed to affix or form a film of the surface-modifying fine particles will not be attained, which is likely to lead to problems such as filming, scattering, and image fogging due to peeling or separation. Raising the temperature of the heat processing in order to avoid this is not preferable, because the core particles become spherical, and mutual fusing of toner particles occurs. For this reason, by selecting the quantity of surface-modifying fine particles to be added from within the range specified above, desired functions (charge control, improvement of preservation, etc.) can be imparted, a strong state of affixing or film formation, which is more resistant to stress, can be obtained, and thus a superior toner can be obtained which is free of peeling or separation during use, and which does not cause poor cleaning.

Incidentally, improving cleaning characteristics by using irregularly-shaped toner particles has the opposite effect from improving charging characteristics and fluidity by making toner particles spherical. However, the charging characteristics and fluidity needed in a powdered toner vary according to the copy machine or printer used. Accordingly, it is not always necessary to improve charging characteristics and fluidity by making toner particles spherical.

Concrete examples of toners according to the present embodiment will be explained below as concrete examples 1 through 6.

(CONCRETE EXAMPLE 1)

The core particles used in concrete example 1 were prepared by mixing, by weight, 100 parts styrene-acrylic copolymer binder resin, 6 parts carbon black, and 3 parts low molecular weight polypropylene in a Henschel mixer, melting and kneading this mixture at 150° C. using a two-shaft extruding kneader, and then, after cooling, the kneaded mixture was first coarsely ground using a feather mill, and then ground and separated in a jet mill. These core particles were irregularly-shaped particles having an average diameter by volume of 10.5 $\mu$m, and a BET specific surface area (S1) of 1.70 $m^2/g$.

The organic surface-modifying fine particles used were made of polymethyl methacrylate (PMMA), and had an average diameter by volume of 0.15 $\mu$m, and a BET specific surface area (S2) of 37.8 $m^2/g$.

Using the foregoing core particles and surface-modifying fine particles, toner was prepared according to the following method.

First, setting the amount of surface-modifying fine particles added at 5 parts by weight ($X=5/(100+5)\approx 0.048$) to 100 parts by weight of core particles, the two kinds of particles were put in a Henschel-type mixer and stirred at 1500 rpm (peripheral speed 10 m/s) for 30 minutes. In this way, the surface-modifying fine particles were dispersed over and attached to the surface of the core particles by van der Waals force and electrostatic force, yielding combined particles in an ordered mixture.

Using the hot air flow surface modification device Suffusing System (Japan Pneumatic Industries Co., Ltd. product) for hot air flow processing (heat processing as shown in FIG. 2) to affix or form a film of the surface-modifying fine particles, toner was obtained by exposing the combined particles to the hot air flow for a short duration of 1 second or less.

Here, for measurement of the BET specific surface area of the core particles ($S_1$), the BET specific surface area of the surface-modifying fine particles ($S_2$), and the BET specific surface area of the toner obtained (S), a value obtained by the one-point measurement method using the BET specific surface area measurement device Gemini 2360 (Shimadzu Manufacturing product) was adopted.

For measuring the average particle diameter of the core particles by volume and the average particle diameter of the toner by volume (D), the Multisizer II (Coulter Electronics Ltd. product) was used, and for measuring the average particle diameter of the surface-modifying fine particles by volume, the Mastersizer (Malvern Instruments Ltd. product) was used.

In concrete example 1, samples T1 through T6, shown in Table 1, were obtained by changing the temperature of the hot air at the time of hot air flow processing. In other words, hot air processing at each of six temperatures from 100° C. to 450° C. was performed on combined particles formed by adding 5 parts by weight of PMMA surface-modifying fine particles (with an average diameter by volume of 0.15 $\mu$m and a BET specific surface area of 37.8 $m^2/g$) to the surface of 100 parts by weight of irregularly-shaped core particles (with an average diameter by volume of 10.5 $\mu$m and a BET specific surface area of 1.70 $m^2/g$). Here, since $S_1=1.70[m^2/g]$, $S_2=37.8\ [m^2/g]$, and $X=0.048\ [m^2/g]$, the BET specific surface area of the combined particles ($S_0$), calculated using equation (2) above, is 3.43 $[m^2/g]$.

TABLE 1

| SAMPLE NO. | HOT AIR TEMPERATURE [° C.] | AVERAGE PARTICLE DIAMETER BY VOLUME [$\mu$m] | BET SPECIFIC SURFACE AREA S [$m^2/g$] |
|---|---|---|---|
| T1 | 100 | 10.9 | 2.210 |
| T2 | 150 | 10.9 | 2.060 |
| T3 | 200 | 10.8 | 1.300 |
| T4 | 300 | 10.9 | 0.637 |

TABLE 1-continued

| SAMPLE NO. | HOT AIR TEMPERATURE [° C.] | AVERAGE PARTICLE DIAMETER BY VOLUME [μm] | BET SPECIFIC SURFACE AREA S [$m^2/g$] |
|---|---|---|---|
| T5 | 400 | 11.0 | 0.542 |
| T6 | 450 | 11.2 | 0.523 |

Next, Table 2 shows the results of evaluation of actual copying after copying 10,000 sheets using each of the samples T1 through T6 with 0.3 parts by weight of silica (Nippon Aerosil Co., Ltd. product R972) mixed in as fluidizing agent. Table 2 also shows the values relating to the equations (1), (4), and (5) for each sample.

Evaluation of actual copying was performed by successive copying of 10,000 sheets using a Sharp Co. copy machine (SF-2027) and then evaluating image fogging, toner scattering, filming, and poor cleaning. In the Table, "○" indicates that the evaluation after copying was good, "Δ" indicates the limit of acceptability for use, and "X" indicates a poor evaluation. In regard to the evaluation of sample T1, image deterioration due to filming was so marked that copying was suspended after 6,000 sheets.

Further, in Table 2, $S/S_0$ corresponds to the coefficient of $S_0$ (the left side of equations (1), (4), and (5)), and $S/S_{calc}$ corresponds to the coefficient of $S_{calc}$ (the right side of the same equations). The specific gravity of the toner particles (ρ) was $1.1\times10^6$ [$g/m^3$].

In this case, the BET specific surface area conditions are $0.60 \geqq S/S_0 \geqq 0.15$ and $4.12 \geqq S/S_{calc} \geqq 1.12$, and, for the same reasons as above, the conditions obtained are: $0.60\ S_0 \geqq S \geqq 1.12\ S_{calc}$.

Further, with samples T3 through T5, all evaluations were good, confirming that temperature conditions of 200° C. to 400° C. were even more preferable. In this case, the BET specific surface area conditions are $0.38 \geqq S/S_0 \geqq 0.15$ and $2.57 \geqq S/S_{cacl} \geqq 1.12$, and, for the same reasons as above, the conditions obtained are: $0.38S_0 \geqq S \geqq 1.12S_{calc}$.

Incidentally, there are cases in which the measured BET specific surface area of toner which has undergone hot air flow processing is close to the calculated BET specific surface area of a hypothetical toner with particles which are perfect spheres. This is due to smoothing of the surface of the particles. Examination with an SEM has confirmed that, with particles having a specific surface of at least 1.1 times that of the hypothetical particles which are perfect spheres, the particles have not become spherical, and maintain a sufficiently irregular shape.

(CONCRETE EXAMPLE 2)

Next, samples T4 and T7 through T10, shown in Table 3, were prepared in the same manner as in concrete example 1, except that the temperature of hot air flow processing was held constant while the average particle diameter of the surface-modifying fine particles by volume was varied. In other words, irregularly-shaped core particles having an average particle diameter by volume of 10.5 μm and a BET specific surface area ($S_1$) of 1.70 $m^2/g$ were used. Then, five

TABLE 2

| SAMPLE NO. | COPYING EVALUATION AFTER 10,000 COPIES: FOGGING | TONER SCATTERING | FILMING | POOR CLEANING | $0.60S_0$ | $1.10S_{CALC}$ | $S_{CALC} = 3/(\rho D/2)$ | $S/S_0$ | $S/S_{CALC}$ |
|---|---|---|---|---|---|---|---|---|---|
| T1 | X | X | X | ○ | 2.058 | 0.550 | 0.500 | 0.64 | 4.42 |
| T2 | Δ | ○ | ○ | ○ | 2.058 | 0.550 | 0.500 | 0.60 | 4.12 |
| T3 | ○ | ○ | ○ | ○ | 2.058 | 0.556 | 0.505 | 0.38 | 2.57 |
| T4 | ○ | ○ | ○ | ○ | 2.058 | 0.550 | 0.500 | 0.19 | 1.27 |
| TS | ○ | ○ | ○ | ○ | 2.058 | 0.546 | 0.496 | 0.15 | 1.12 |
| T6 | X | Δ | X | X | 2.058 | 0.536 | 0.487 | 0.14 | 1.07 |

○: GOOD Δ: FAIR (LIMIT OF ACCEPTABILITY FOR USE) X: POOR

As shown in Table 2, with sample T1, which underwent hot air flow processing at 100° C., affixing of the surface-modifying fine particles was insufficient, and image fogging and toner scattering occurred. Filming also occurred after approximately 5,000 copies. Again, with sample T6, which underwent hot air flow processing at 450° C., poor cleaning occurred after approximately 8,500 copies, and was accompanied by image fogging and toner scattering.

As a result, it can be seen that a hot air temperature of more than 100° C. but less than 450° C. is preferable. In this case, the BET specific surface area conditions are $0.64>S/S_0>0.14$ and $4.42>S/S_{calc}>1.07$, and since the maximum limit of the toner's BET specific surface area is based on $S_0$, and its minimum limit on $S_{calc}$ the conditions obtained are: $0.64\ S_0>S>1.07\ S_{calc}$.

With samples T2 through T5, good images which were at or better than the limit of acceptability for use were obtained in evaluation after 10,000 copies. Thus it can be seen that temperature conditions of 150° C. to 400° C. are preferable.

types of combined particles (samples T4 and T7 to T10) were prepared by adding to the surface of the core particles, by weight, 5 parts PMMA surface-modifying fine particles with average particle diameters by volume ranging from 0.1 μm to 2.0 μm. Each type of combined particle was then processed in a hot air flow of 300° C.

In addition, Table 4 shows the results of evaluation of actual copying after copying 10,000 sheets using each of the samples T4 and T7 through T10 with, as in concrete example 1, 0.3 parts by weight of silica (Nippon Aerosil Co., Ltd. product R972) mixed in as fluidizing agent. Table 4 also shows the values relating to the equations (1), (4), and (5) for each sample. The method of making these evaluations was the same as that of concrete example 1. Further, the specific gravity (ρ) of the toner particles was also the same as in concrete example 1, i.e., $1.1\times10^6$ [$g/m^3$].

TABLE 3

| SAMPLE NO. | PMMA SURFACE-MODIFYING FINE PARTICLES: AVERAGE PARTICLE DIAMETER BY VOLUME [μm] | PMMA SURFACE-MODIFYING FINE PARTICLES: BET SPECIFIC SURFACE AREA $S_2$ [$m^2/g$] | COMBINED PARTICLES: BET SPECIFIC SURFACE AREA $S_0$ [$m^2/g$] | SURFACE-MODIFIED TONER: AVERAGE PARTICLE DIAMETER BY VOLUME D [μm] | SURFACE-MODIFIED TONER: BET SPECIFIC SURFACE AREA S [$m^2/g$] |
|---|---|---|---|---|---|
| T7 | 0.1 | 55.9 | 4.30 | 10.6 | 0.788 |
| T4 | 0.15 | 37.8 | 3.43 | 10.9 | 0.637 |
| T8 | 0.4 | 13.7 | 2.28 | 11.6 | 0.621 |
| T9 | 1.0 | 5.42 | 1.88 | 12.2 | 0.818 |
| T10 | 2.0 | 2.83 | 1.76 | 12.0 | 1.25 |

TABLE 4

| SAMPLE NO. | COPYING EVALUATION AFTER 10,000 COPIES: FOGGING | TONER SCATTERING | FILMING | POOR CLEANING | $0.60S_0$ | $1.10S_{CALC}$ | $S_{CALC} = 3/(\rho D/2)$ | $S/S_0$ | $S/S_{CALC}$ |
|---|---|---|---|---|---|---|---|---|---|
| T7 | ○ | ○ | ○ | ○ | 2.58 | 0.567 | 0.515 | 0.18 | 1.53 |
| T4 | 0 | 0 | 0 | 0 | 2.06 | 0.550 | 0.500 | 0.19 | 1.27 |
| T8 | 0 | 0 | 0 | 0 | 1.37 | 0.517 | 0.470 | 0.27 | 1.32 |
| T9 | A | 0 | 0 | 0 | 1.23 | 0.492 | 0.447 | 0.33 | 1.83 |
| T10 | X | X | 0 | 0 | 1.06 | 0.501 | 0.455 | 0.71 | 2.75 |

○: GOOD Δ: FAIR (LIMIT OF ACCEPTABILITY FOR USE) X: POOR

As shown in Table 4, with sample T10, which used PMMA surface-modifying fine particles 2.0 μm in average particle diameter by volume, fogging of white areas of the image and toner scattering occurred to such an extent that this toner was unsuitable for use. This is probably caused by a great amount of fine powder toner due to a large number of surface-modifying fine particles existing separately from the core particles, without being attached thereto, and by inferior charging stability due to failure to form a uniform film.

Thus it can be seen that PMMA surface-modifying fine particles less than 2.0 μm in average particle diameter by volume are preferable. In this case, the BET specific surface area conditions are $0.71>S/S_0$ and $2.75>S/S_{calc}$, and since the maximum limit of the toner's BET specific surface area is based on $S_0$, the conditions obtained are: $0.71S_0>S$.

Further, with samples T7, T4, T8, and T9, copying characteristics which were at or better than the limit of acceptability for use were obtained. Thus it was confirmed that PMMA surface-modifying fine particles of from 0.1 μm to 1.0 μm in average particle diameter by volume are preferable. In this case, the BET specific surface area conditions are $0.33\geqq S/S_0$ and $1.83\geqq S/S_{calc}$, and, for the same reasons as above, the conditions obtained are: $0.33S_0\geqq S$.

Further, with samples T7, T4, and T8, all evaluations were good, confirming that PMMA surface-modifying fine particles of from 0.1 μm to 0.4 μm in average particle diameter by volume were even more preferable. In this case, the BET specific surface area conditions are $0.27\geqq S/S_0$ and $1.53\geqq S/S_{calc}$, and, for the same reasons as above, the conditions obtained are: $0.27S_0\geqq S$.

(CONCRETE EXAMPLE 3)

Next, samples T4 and T11 through T14, shown in Table 5, were prepared in the same manner as in concrete example 1, except that the temperature of hot air flow processing was held constant while the quantity of surface-modifying fine particles added was varied. In other words, irregular-shaped core particles having an average particle diameter by volume of 10.5 μm and a BET specific surface area ($S_1$) of 1.70 $m^2/g$ were used. Then, five types of combined particles (samples T4 and T11 to T14) were prepared by adding to the surface of the core particles PMMA surface-modifying fine particles with an average particle diameter by volume of 0.15 μm and a BET specific surface area ($S_2$) of 37.8 $m^2/g$ in quantities ranging from 0.1 part to 20 parts by weight. Each type of combined particle was then processed in a hot air flow of 300° C.

In addition, Table 6 shows evaluation of actual copying after copying 10,000 sheets using each of the samples T4 and T11 through T14 with, as in concrete example 1, 0.3 parts by weight of silica (Nippon Aerosil Co., Ltd. product R972) mixed in as fluidizing agent. Table 6 also shows the values relating to the equations (1), (4), and (5) for each sample. The method of making these evaluations was the same as that of concrete example 1. Further, the specific gravity (ρ) of the toner particles was also the same as in concrete example 1, i.e., $1.1\times10^6$ [$g/m^3$].

TABLE 5

| SAMPLE NO. | PMMA SURFACE-MODIFYING FINE PARTICLES QUANTITY ADDED [PARTS BY WEIGHT] | PMMA SURFACE-MODIFYING FINE PARTICLES COMPOSITION RATIO X | COMBINED PARTICLES BET SPECIFIC SURFACE AREA $S_0$ [$m^2/g$] | SURFACE-MODIFIED TONER AVERAGE PARTICLE DIAMETER BY VOLUME D [$\mu m$] | SURFACE-MODIFIED TONER BET SPECIFIC SURFACE AREA S [$m^2/g$] |
|---|---|---|---|---|---|
| T11 | 0.1 | 0.0010 | 1.74 | 10.6 | 0.568 |
| T12 | 1 | 0.010 | 2.06 | 10.6 | 0.582 |
| T4 | 5 | 0.048 | 3.43 | 10.9 | 0.637 |
| T13 | 15 | 0.13 | 6.39 | 11.5 | 3.67 |
| T14 | 20 | 0.17 | 7.84 | 11.8 | 6.19 |

TABLE 6

| SAMPLE NO. | COPYING EVALUATION AFTER 10,000 COPIES FOGGING | TONER SCATTERING | FILMING | POOR CLEANING | $0.60S_0$ | $1.10S_{CALC}$ | $S_{CALC} = 3/(\rho D/2)$ | $S/S_0$ | $S/S_{CALC}$ |
|---|---|---|---|---|---|---|---|---|---|
| T11 | ○ | ○ | ○ | Δ | 1.04 | 0.567 | 0.515 | 0.32 | 1.10 |
| T12 | ○ | ○ | ○ | ○ | 1.24 | 0.550 | 0.515 | 0.28 | 1.13 |
| T4 | ○ | ○ | ○ | ○ | 2.06 | 0.517 | 0.500 | 0.19 | 1.27 |
| T13 | Δ | Δ | ○ | ○ | 3.83 | 0.492 | 0.474 | 0.57 | 7.74 |
| T14 | X | X | X | ○ | 4.70 | 0.501 | 0.462 | 0.79 | 13.4 |

○: GOOD Δ: FAIR (LIMIT OF ACCEPTABILITY FOR USE) X: POOR

As shown in Table 6, with sample T14, in which 20 parts by weight of PMMA surface-modifying fine particles were added, image fogging and toner scattering occurred, as did filming after copying approximately 8,000 sheets, to such an extent that this toner was unsuitable for use.

Thus it can be seen that addition of less than 20 parts by weight of PMMA surface-modifying fine particles is preferable. In this case, the BET specific surface area conditions are $0.79>S/S_0$ and $13.4>S/S_{calc}$, and since the maximum limit of the toner's BET specific surface area is based on $S_0$, the conditions obtained are: $0.79S_0>S$.

Further, with samples T11, T12, T4, and T13, copying characteristics which were at or better than the limit of acceptability for use were obtained. Thus it was confirmed that addition of from 0.1 part to 15 parts by weight of PMMA surface-modifying fine particles is preferable. In this case, the BET specific surface area conditions are $0.57\geqq S/S_0$ and $7.74\geqq S/S_{calc}\geqq 1.10$. Accordingly, for the same reasons as above, the conditions obtained are: $0.57S_0\geqq S\geqq 1.10S_{calc}$.

Further, with samples T12 and T4, all evaluations were good. Accordingly, it was confirmed that addition of from 1 part to 5 parts by weight of PMMA surface-modifying fine particles is even more preferable. In this case, the BET specific surface area conditions are $0.28\geqq S/S_0\geqq 0.19$ and $1.27\geqq S/S_{calc}\geqq 1.13$, and, for the same reasons as above, the conditions obtained are: $0.28S_0\geqq S\geqq 1.13S_{calc}$.

The foregoing concrete examples 1 through 3 confirmed that preferred BET specific surface area conditions are $0.64S_0>S>1.07S_{calc}$. Further, it was confirmed that conditions of $0.60S_0\geqq S\geqq 1.10S_{calc}$ are more preferable, and that conditions of $0.38S_0\geqq S\geqq 1.12S_{calc}$ are even more preferable.

(CONCRETE EXAMPLE 4)

Next, samples T15 through T19, shown in Table 7, were prepared in the same manner as in concrete example 1, except that the glass transition point ($Tg_2$) and weight-averages molecular weight (Mw) of the surface-modifying fine particles were held constant while the glass transition point of the core particles ($Tg_1$) was varied. In other words, core particles with average particle diameter by volume adjusted to 10.5 $\mu$m, and having glass transition points ranging from 35° C. to 75° C. were used. Then, five types of combined particles (samples T15 through T19) were prepared by adding to the surface of each type of core particle 5 parts by weight of PMMA surface-modifying fine particles with an average particle diameter by volume of 0.15 $\mu$m, a glass transition point of 72° C., and a weight-average molecular weight of 120,000. Each type of combined particle was then processed in a hot air flow of 300° C.

In addition, samples T17 and T20 through T23, shown in Table 7, were prepared in the same manner as in concrete example 1, except that the glass transition point of the core particles ($Tg_1$) and the weight-average molecular weight of the surface-modifying fine particles (Mw) was held constant while the glass transition point of the surface-modifying fine particles ($Tg_2$) was varied. In other words, core particles with average particle diameter by volume adjusted to 10.5 $\mu$m, and having a glass transition point of 55° C. were used. Then, five types of combined particles (samples T17, T20 to T23) were prepared by adding to the surface of the core particles 5 parts by weight of PMMA surface-modifying fine particles with an average particle diameter by volume of 0.15 $\mu$m, glass transition points ranging from 55° C. to 108° C., and a weight-average molecular weight of 120,000. Each type of combined particle was then processed in a hot air flow of 300° C.

In addition, Table 7 shows evaluation of actual copying after copying 10,000 sheets, fixing, and preservation using each of the samples T15 through T23 with, as in concrete example 1, 0.3 parts by weight of silica (Nippon Aerosil Co., Ltd. product R972) mixed in as fluidizing agent.

The method of evaluating actual copying was the same as that of concrete example 1.

Fixing was evaluated by a performing a rubbing test (1 kgw) with a sand eraser (Lion Co., Ltd. product ER-502K)

in a device for testing fastness to rubbing, and then measuring the percentage of fixed toner remaining after rubbing. In this evaluation, if 80% or more of the toner remained after rubbing, the toner was considered satisfactory for actual use.

Preservation was evaluated by filling a cartridge for the copy machine (SF-2027) with 320 g of toner, letting stand at 45° C. for 2 weeks, and then checking for blocking.

TABLE 7

| SAMPLE NO. | CORE PARTICLES $Tg_1$ [° C.] | SURFACE-MODIFYING FINE PARTICLES $Tg_2$ [° C.] | Mw | SURFACE-MODIFIED TONER COPYING EVALUATION AFTER 10,000 COPIES FOGGING | FILMING | POOR CLEANING | FIXING | PRESERVATION |
|---|---|---|---|---|---|---|---|---|
| T15 | 75 | 72 | 120,000 | ○ | ○ | ○ | X | ○ |
| T16 | 70 | | | ○ | ○ | ○ | ○ | ○ |
| T17 | 55 | | | ○ | ○ | ○ | ○ | ○ |
| T18 | 40 | | | ○ | ○ | ○ | ○ | ○ |
| T19 | 35 | | | X | X | X | ○ | X |
| T20 | 55 | 108 | 120,000 | X | X | ○ | X | ○ |
| T21 | | 100 | | ○ | ○ | ○ | ○ | ○ |
| T17 | | 72 | | ○ | ○ | ○ | ○ | ○ |
| T22 | | 60 | | ○ | ○ | ○ | ○ | ○ |
| T23 | | 55 | | X | ○ | X | ○ | X |

○: GOOD Δ: FAIR (LIMIT OF ACCEPTABILITY FOR USE) X: POOR

Since, as shown in Table 7, samples T16 through T18 had good copying evaluation, fixing, and preservation, it was confirmed that core particles with a glass transition point of 40° C. to 70° C. are preferable. In contrast, sample T15, which had core particles with a glass transition point of 75° C., had inferior fixing. Again, sample T19, which had core particles with a glass transition point of 35° C., had poor copying evaluation in each area, and preservation was impaired, making it unsuitable for actual use.

Further, samples T21, T17, and T22 had good copying evaluation, fixing, and preservation. Accordingly, it was confirmed that surface-modifying fine particles with a glass transition point of 60° C. to 100° C. are preferable. In contrast, with sample T20, which had surface-modifying fine particles with a glass transition point of 108° C., image fogging and filming occurred, and fixing was also impaired. Again, with sample T23, which had surface-modifying fine particles with a glass transition point of 55° C., image fogging and poor cleaning occurred, and preservation was impaired. For these reasons, samples T20 and T23 were unsuitable for actual use.

(CONCRETE EXAMPLE 5)

Next, samples T17 and T24 through T27, shown in Table 8, were prepared in the same manner as in concrete example 1, except that the glass transition points of the core particles ($Tg_1$) and the surface-modifying fine particles ($Tg_2$) were held constant while the weight-average molecular weight (Mw) of the surface-modifying fine particles was varied. In other words, core particles with average particle diameter by volume adjusted to 10.5 μm, and having a glass transition point of 55° C. were used. Then, five types of combined particles (samples T17, T24 to T27) were prepared by adding to the surface of the core particles 5 parts by weight of PMMA surface-modifying fine particles with an average particle diameter by volume of 0.15 μm, a glass transition point of 72° C., and weight-average molecular weights ranging from 45,000 to 250,000. Each type of combined particle was then processed in a hot air flow of 300° C.

In addition, Table 8 shows evaluation of actual copying after copying 10,000 sheets, fixing, and preservation using each of the samples T17 and T24 through T27 with, as in concrete example 1, 0.3 parts by weight of silica (Nippon Aerosil Co., Ltd. product R972) mixed in as fluidizing agent. The method of making these evaluations was the same as that of concrete example 1. Further, the methods of evaluating fixing and preservation were the same as in concrete example 4.

TABLE 8

| SAMPLE NO. | CORE PARTICLES $Tg_1$ [° C.] | SURFACE-MODIFYING FINE PARTICLES $Tg_2$ [° C.] | Mw | SURFACE-MODIFIED TONER COPYING EVALUATION AFTER 10,000 COPIES FOGGING | FILMING | POOR CLEANING | FIXING | PRESERVATION |
|---|---|---|---|---|---|---|---|---|
| T24 | 55 | 72 | 45,000 | ○ | ○ | ○ | X | X |
| T25 | | | 50,000 | ○ | ○ | ○ | ○ | ○ |
| T17 | | | 120,000 | ○ | ○ | ○ | ○ | ○ |
| T26 | | | 210,000 | ○ | ○ | ○ | ○ | ○ |
| T27 | | | 250,000 | X | X | X | X | ○ |

○: GOOD Δ: FAIR (LIMIT OF ACCEPTABILITY FOR USE) X: POOR

Since, as shown in Table 8, samples T25, T17, and T26 had good copying evaluation, fixing, and preservation, it was confirmed that a weight-average molecular weight of the surface-modifying fine particles of 50,000 to 210,000 is preferable. In contrast, with sample T24, which had a weight-average molecular weight of 45,000, fixing and preservation were impaired. Again, sample T27, which had a weight-average molecular weight of 250,000, had poor copying evaluation in each area, and fixing was also impaired. Accordingly, samples T24 and T27 were unsuitable for actual use.

(CONCRETE EXAMPLE 6)

Next, samples T28 through T30, shown in Table 9, were prepared using core particles of styrene-acrylic copolymer or polyester resin, and surface-modifying fine particles of PMMA or styrene-PBMA copolymer. In other words, two types of core particles with average particle diameter by volume adjusted to 10.5 μm were used. Then, three types of combined particles (samples T28 through T30) were prepared by adding 5 parts by weight of surface-modifying fine particles with an average particle diameter by volume of 0.4 μm, but with different SP values, to the surface of each type of core particle. Each type of combined particle was then processed in a hot air flow of 300° C., producing toners with an average particle diameter by volume of approximately 11.5 μm.

Table 9 also shows the results of evaluation of actual copying after copying 10,000 sheets using each of the samples T28 through T30 with, as in concrete example 1, 0.3 parts by weight of silica (Nippon Aerosil Co., Ltd. product R972) mixed in as fluidizing agent.

TABLE 9

| SAMPLE NO. | CORE PARTICLES CHIEF RESIN COMPONENT | CORE PARTICLES SP VALUE | SURFACE-MODIFYING FINE PARTICLES COMPOSITION | SURFACE-MODIFYING FINE PARTICLES SP VALUE | ABSOLUTE VALUE OF DIFFERENCE IN SP VALUES | SURFACE-MODIFIED TONER COPYING EVALUATION AFTER 10,000 COPIES FOGGING | SURFACE-MODIFIED TONER COPYING EVALUATION AFTER 10,000 COPIES FILMING |
|---|---|---|---|---|---|---|---|
| T28 | STYRENE-ACRYLIC | 8.5 | PMMA | 9.8 | 1.3 | ○ | ○ |
| T29 | POLYESTER | 10.7 | STYRENE-PBMA | 8.7 | 2.0 | ○ | ○ |
| T30 | POLYESTER | 10.7 | STYRENE-PBMA | 8.5 | 2.2 | X | X |

○: GOOD Δ: FAIR (LIMIT OF ACCEPTABILITY FOR USE) X: POOR

As Table 9 shows, with sample T30, in which the difference in the SP values of the core particles and surface-modifying fine particles was 2.2, image fogging occurred due to peeling and separation of the surface-modifying fine particles from the surface of the core particles, and filming also occurred after approximately 7,000 copies. For this reason, it was confirmed that a difference in SP values of less than 2.2 is preferable. Again, since samples T28 and T29 had good evaluations in each area, it was confirmed that a difference in SP values of 2.0 or less is more preferable.

As has been discussed above, electrophotographic toner according to the present embodiment is made up of irregularly-shaped core particles chiefly composed of binder resin, and surface-modifying fine particles which are first dispersed over and attached to the surface of the core particles, and then affixed or made into a film thereon, so as to produce toner particles, in which the BET specific surface area, based on $N_2$ adsorption, of the toner particles satisfies:

$$0.64S_0>S>1.07\times[3/(\rho D/2)]; \text{ and}$$

$$S_0=S_1X+S_2(1-X),$$

where:

S is the BET specific surface area of the toner particles;

$S_0$ is the BET specific surface area of the core particles and the surface-modifying fine particles combined together;

$S_1$ is the BET specific surface area of the core particles alone;

$S_2$ is the BET specific surface area of the surface-modifying fine particles alone;

ρ is the specific gravity of the toner particles;

D is the average particle diameter of the toner particles by volume; and

X is the ratio of composition of the surface-modifying fine particles based on a weight standard.

With the foregoing structure, the toner's BET specific surface area is less than $0.64S_0$; in other words, the surface-modifying fine particles are sufficiently affixed to the surface of the core particles, and thus problems like filming and toner scattering will not occur. Further, the toner's BET specific surface area is more than 1.07 times that of hypothetical toner particles which are perfect spheres; in other words, the toner particles are not spherical, and thus poor cleaning can be prevented.

As a result, a surface-modified toner can be obtained in which the surface-modifying fine particles dispersed over and attached to the surface of the core particles are affixed or made into a film thereon strongly enough so that they will not peel or separate therefrom, but without producing spherical toner particles, thus avoiding problems such as poor cleaning.

Further, it is more preferable if the electrophotographic toner has toner particles with a BET specific surface area of no more than 0.60 times the BET specific surface area of the core particles and surface-modifying fine particles when combined together, and no less than 1.10 times the BET specific surface area of hypothetical toner particles which are perfect spheres. In this case, a better toner can be obtained, in which poor cleaning and peeling or separation of the surface-modifying fine particles do not occur.

Further, it is even more preferable if the electrophotographic toner has toner particles with a BET specific surface area of no more than 0.38 times the BET specific surface area of the core particles and surface-modifying fine particles when combined together, and no less than 1.12 times the BET specific surface area of hypothetical toner particles which are perfect spheres. In this case, an even better toner can be obtained, in which poor cleaning and peeling or separation of the surface-modifying fine particles do not occur.

In addition, it is preferable if the electrophotographic toner is made up of surface-modifying fine particles having a glass transition point which is higher than that of the core particles, and if the glass transition point of the core particles is 40° C. to 70° C., and that of the surface-modifying fine particles is 60° C. to 100° C.

In this case, surface-modifying fine particles are used which have a higher glass transition point than that of the core particles. Surface-modifying fine particles which are within a range which does not sacrifice fixing performance are combined with core particles which are capable of low-temperature fixing while maintaining strong fixing. Thus, low-temperature fixing of the core particles can be realized, and the preservation of the surface-modifying fine particles can be improved, enabling a toner with superior low-temperature fixing and preservation. Further, with the foregoing combination, a toner can be obtained which is free of peeling or separation of the surface-modifying fine particles.

Again, it is preferable if surface-modifying fine particles with an average particle diameter by volume of no more than 1 $\mu$m are used in the electrophotographic toner. In this case, by using surface-modifying fine particles no more than 1 $\mu$m in average particle diameter by volume, a strong state of affixing or film formation which is resistant to stress can be obtained, thus enabling a superior toner which is not prone to peeling or separation, and which will not cause poor cleaning.

Further, it is preferable if the surface-modifying fine particles used in the electrophotographic toner are organic surface-modifying fine particles having a weight-average molecular weight of from 50,000 to 210,000. In this case, by using surface-modifying fine particles with a weight-average molecular weight within the foregoing range, a strong state of affixing or film formation which is resistant to stress can be obtained, thus enabling a superior toner which is not prone to peeling or separation, and which will not cause poor cleaning.

In addition, it is preferable if the surface-modifying fine particles used in the electrophotographic toner are organic surface-modifying fine particles, and if the absolute value of the difference in the solubility parameter values of the organic surface-modifying fine particles and the core particles is no more than 2.0. In this case, since the difference in solubility parameter values of the organic surface-modifying fine particles and the binder resin of the core particles is no more than 2.0, the two materials have good compatibility, resulting in a strong state of affixing or film formation, thus enabling a superior toner which is not prone to peeling or separation, and which will not cause poor cleaning.

In addition, it is preferable if the surface-modifying fine particles used in the electrophotographic toner are organic surface-modifying fine particles, and if 0.1 part to 15 parts by weight of the organic surface-modifying fine particles are added for 100 parts by weight of the core particles. In this case, by adding the organic surface-modifying fine particles in a quantity within the foregoing range, desired performance, such as charge control and improvement of preservation, can be imparted, and a strong state of affixing or film formation which is resistant to stress can be obtained, thus enabling a superior toner which is not prone to peeling or separation, and which will not cause poor cleaning.

The method of manufacturing electrophotographic toner according to the present embodiment includes the steps of dispersing and attaching surface-modifying fine particles on the surface of irregularly-shaped core particles chiefly composed of binder resin, so as to produce combined particles; and affixing or forming a film of the surface-modifying fine particles on the surface of the core particles, so as to produce toner particles; in which the toner particles are manufactured so that their BET specific surface area, based on $N_2$ adsorption, satisfies:

$$0.64S_0>S>1.07\times[3/(\rho D/2)]; \text{ and}$$

$$S_0=S_1X+S_2(1-X),$$

where:

S is the BET specific surface area of the toner particles;

$S_0$ is the BET specific surface area of the core particles and the surface-modifying fine particles combined together;

$S_1$ is the BET specific surface area of the core particles alone;

$S_2$ is the BET specific surface area of the surface-modifying fine particles alone;

$\rho$ is the specific gravity of the toner particles;

D is the average particle diameter of the toner particles by volume; and

X is the ratio of composition of the surface-modifying fine particles based on a weight standard.

With the foregoing manufacturing method, since the state of surface modification can be quantitatively grasped by means of the BET specific surface area, the state of surface modification can be controlled to produce a toner which is in a uniform and stable state. Here, the state of surface modification can be controlled by changing the various parameters of the manufacturing process (which include device conditions such as temperature, duration of exposure, and quantity processed, and the composition, combination ratio, particle diameter, shape, glass transition point, and molecular weight of the core particles and surface-modifying fine particles).

In the foregoing method of manufacturing electrophotographic toner, it is preferable, in the step for producing the toner, to expose the combined particles to a hot air flow area in such a way that the temperature applied to the surface-modifying fine particles and to the surface of the core particles is at or above the softening point of these respective particles, but the temperature applied to the interior of the core particles is insufficient to soften the core particles, and then to cool the toner particles produced thereby.

In this case, the surface-modifying fine particles can be affixed or formed into a film on the surface of the core particles while maintaining the irregular shape of the core particles, thus enabling production of a toner which will not cause poor cleaning.

In addition, in the foregoing method of manufacturing electrophotographic toner, it is preferable if the temperature of the hot air flow area is more than 100° C. but less than 450° C., and if the duration of exposure of the combined particles in the hot air flow area is less than 1 second. In this case, since the temperature of the hot air flow area is within the foregoing range, the surface-modifying fine particles are sufficiently affixed to the core particles without blocking of the toner. Further, since the exposure time is less than 1 second, processing speed is not slowed.

[Second Embodiment]

The electrophotographic toner according to the present embodiment (hereinafter referred to simply as "toner") is made up of toner particles, each of which, as shown in FIG. 1(*c*), is composed of surface-modifying fine particles 2 affixed or formed into a film on the surface of a core particle 1. Further, the surface-modifying fine particles 2 are fine polymer particles having a weight-average molecular weight (Mw) of 30,000 to 800,000.

Surface-modifying fine particles made of fine polymer particles having a weight-average molecular weight (Mw) of 30,000 to 800,000 in this way are strong enough to serve as a shell which protects the core particles and improves the heat resistance (storage stability) of the toner. Further, the fine polymer particles and the core particles have superior compatibility. For this reason, by affixing or forming a film of the fine polymer particles, the fine polymer particles and core particles can be fused, forming a strong film on the surface of the core particles, without making the irregularly-shaped core particles spherical. This prevents separation, peeling, and floating of the fine polymer particles due, for example, to mechanical stress in the developing vessel during successive copying. Accordingly, impairment of image quality due to problems such as filming, toner scattering, and image fogging can be prevented. In addition, poor cleaning due to spherical toner particles can also be prevented.

If the weight-average molecular weight of the fine polymer particles is less than 30,000, the fine polymer particles affixed or formed into a film will not be strong enough to serve as a shell which protects the core particles and improves the heat resistance (storage stability) of the toner. As a result, mechanical stress in the developing vessel during successive copying, etc. gives rise to separation, peeling, and floating of the fine polymer particles, leading to impairment of image quality. Accordingly, a toner using fine polymer particles of this kind is not preferable, because it will have inferior stability over time.

Again, if the weight-average molecular weight of the fine polymer particles is more than 800,000, the compatibility of the core particles and the fine polymer particles is impaired, and, under normal manufacturing conditions (affixing/film formation conditions), fusing of the core particles and fine polymer particles will be incomplete. As a result, the fine polymer particles cannot be strongly affixed or formed into a film on the surface of the core particles. Accordingly, mechanical stress in the developing vessel during successive copying, etc. gives rise to separation, peeling, and floating of the fine polymer particles, leading to impairment of image quality.

Further, if, in order to increase the compatibility of fine polymer particles of this kind and the core particles, strong mechanical impact force, heat energy, etc. is used to affix or form a film of the fine polymer particles on the surface of the core particles, the toner particles will become spheres without rough edges, leading to poor cleaning. Accordingly, a toner prepared with fine polymer particles having a weight-average molecular weight of more than 800,000 is not preferable, because it will not be able to provide both stability over time (long life during successive copying) and good cleaning.

Further, it is preferable if the weight-average molecular weight of the fine polymer particles is within a range from 50,000 to 200,000. By adjusting the weight-average molecular weight of the fine polymer particles to within this range, the compatibility of the core particles and the fine polymer particles can be further increased, and the strength of the film formed by fusing of the core particles with the fine polymer particles can be further increased. Accordingly, separation, peeling, and floating of fine polymer particles due, for example, to mechanical stress in the developing vessel during successive copying, and poor cleaning caused by spherical toner particles can both be prevented with even greater certainty. In addition, since fine polymer particles having superior heat resistance are affixed or formed into a film on the surface of core particles capable of low-temperature fixing, a toner can be provided which is capable of low-temperature fixing, and has superior heat resistance (storage stability).

If the weight-average molecular weight of the fine polymer particles is less than 50,000, the fine polymer particles affixed or formed into a film will in some cases not be strong enough to serve as a shell which protects the core particles and improves the heat resistance (storage stability) of the toner. As a result, mechanical stress in the developing vessel during successive copying, etc. gives rise to slight separation, peeling, and floating of the fine polymer particles, which may lead to slight impairment of image quality. Accordingly, the toner will have insufficient stability over time, and its storage stability is somewhat impaired.

Again, if the weight-average molecular weight of the fine polymer particles is more than 200,000, the shell formed of a film of the fine polymer particles will be too strong. In this case, when core particles capable of low-temperature fixing are used, their low-temperature fixing ability may be impaired. Accordingly, the toner may be insufficiently capable of low-temperature fixing (low-energy fixing).

In the first embodiment above and in the present embodiment, the weight-average molecular weight of the fine polymer particles (or the organic surface-modifying fine particles) was measured by means of the following measurement method using gel permeation chromatography.

In this measurement method, first, 0.1 g of the sample is completely dissolved in 30 ml of tetrahydrofuran, which is filtered using a teflon filter with apertures of 0.45 $\mu$m, and this filtrate is then used as the sample solution.

Next, using a syringe of 5 ml capacity, the sample solution is injected into a column of a gel permeation chromatography unit (Toyo Soda Industries Co., Ltd. product HLC-802UR), and a gel permeation chromatography chart is obtained by pouring into the column tetrahydrofuran (as developing solvent) at a flow rate of 1.2 ml/min. For the above-mentioned column, the G7000HxL, the $GMH_6$, the $G2500H_3$ (all Toyo Soda Industries Co., Ltd. products), etc. may be used.

Next, each count of the chart obtained is divided into discretionary widths (to improve precision, division into 5 or more is preferable), and the height (detected quantity) of each is found. Then, using a calibration curve prepared in advance, the weight-average molecular weight of the sample is calculated by styrene conversion. Incidentally, this calibration curve is prepared by plotting on a semilogarithmic graph the relation between count number and weight-average molecular weight of standard polystyrene.

The fine polymer particles may be fine homopolymer particles obtained by polymerizing a single monomer, or fine copolymer particles obtained by polymerizing two or more monomers. For example, monomers which may be used to obtain the fine polymer particles include acrylic alkylesters such as methyl acrylate, ethyl acrylate, iso-butyl acrylate, and n-butyl acrylate; methacrylic alkylesters such as methyl methacrylate, ethyl methacrylate, iso-butyl methacrylate, and n-butyl methacrylate; styrene; and alkyl substituted styrenes such as p-methyl styrene. Further, monomers which may be used to obtain the fine polymer particles also include halogen-containing monomers such as vinyl benzyl chloride, and monomers having a polar group such as an amino group, an amide group, carboxylic acid, or sulfonic acid (for example, sodium styrensulfonate, acrylic acid, methacrylic acid, dimethyl aminoethyl acrylate, and dimethyl aminoethyl meth-acrylate).

It is preferable if the fine polymer particles are obtained by polymerization of at least one monomer chosen from the following: acrylic alkylester, methacrylic alkylester, styrene, and alkyl substituted styrene. Further, it is even more preferable if the fine polymer particles are obtained by polymerization of at least one monomer chosen from the following: an acrylic alkylester having no more than 4 carbon atoms in the alkyl group, a methacrylic alkylester having no more than 4 carbon atoms in the alkyl group, styrene, and an alkyl substituted styrene having no more than 4 carbon atoms in the alkyl group.

By using at least one of the foregoing, the compatibility of the core particles and the fine polymer particles can be further increased, as can the strength of the film formed by fusing of the core particles and the fine polymer particles. Accordingly, a toner can be obtained in which separation, peeling, and floating of the fine polymer particles due, for example, to mechanical stress in the developing vessel during successive copying, and poor cleaning due to spherical toner particles, can both be prevented with even greater certainty.

With the toner according to the present embodiment, as with that according to the first embodiment, compatibility between the binder resin of the core particles and the fine polymer particles is good when the absolute value of the difference in the SP values of the two materials is 2.0 or less. Accordingly, in this case, strong affixing/film formation is possible, and a good condition free of separation, peeling, and floating of the fine polymer particles can be obtained. In light of the foregoing, when the fine polymer particles are obtained by polymerization of one or more of the monomers listed above, it is especially preferable if the binder resin is styrene-(meth)acrylic resin.

Further, it is preferable if the fine polymer particles have positive or negative chargeability. The fine polymer particles can be given positive or negative chargeability by performing the polymerization reaction of the monomer(s) using a water-soluble polymerization initiator such as potassium persulfate, ammonium persulfate, and amidinopropane-base, or by performing the polymerization reaction in the presence of a monomer having a polar group such as an amino group, an amide group, a carboxylic acid group, or a sulfonic acid group.

The method of polymerizing the monomer(s) is a well-known method such as emulsion polymerization, soap-free emulsion polymerization, or dispersion polymerization. In normal emulsion polymerization, fine polymer particles approximately 0.05 μm to 0.1 μm in diameter can be obtained. Again, in normal soap-free emulsion polymerization, fine polymer particles approximately 0.1 μm to 3 μm in diameter can be obtained. Further, in normal dispersion polymerization, fine polymer particles approximately 0.2 μm to 10 μm in diameter can be obtained. Incidentally, soap-free emulsion polymerization is emulsion polymerization which does not use a surfactant.

By being affixed or formed into a film on the surface of the core particles, the fine polymer particles according to the present embodiment form a heat-resistant protective film (shell) which protects the core particles, which are capable of low-temperature fixing. By this means, the fine polymer particles perform the function of improving the heat resistance (storage stability) of the toner.

For this reason, the fine polymer particles and the core particles have the following heat characteristics. Namely, the glass transition point of the fine polymer particles ($Tg_2$) is higher than the glass transition point of the core particles ($Tg_1$), with that of the core particles being from 40° C. to 65° C., and that of the fine polymer particles being from 58° C. to 100° C. By adjusting the glass transition point of the fine polymer particles to within the foregoing range, the toner according to the present embodiment is provided both with low-temperature fixing ability and with anti-blocking characteristics and stability over time.

If the glass transition point of the fine polymer particles is less than 58° C., the toner particles will be likely to change shape due to their own weight in, for example, the toner bottle in which the toner is stored. In this case, the area of contact between adjacent toner particles increases, and the force between toner particles is increased. Accordingly, the toner particles are likely to fuse together, causing blocking. Further, due to, for example, heat stress in the developing vessel during successive copying, melting, separation, etc. of the fine polymer particles occurs, leading to deterioration of the toner itself or of the friction charging member (carrier etc.). This, in turn, leads to impairment of image quality, and the toner's stability over time cannot be maintained.

On the other hand, if the glass transition point of the fine polymer particles is more than 100° C., low-temperature fixing ability is impaired. For this reason, the low-temperature fixing core particles will be unable to show their low-temperature fixing ability, and the toner's low-temperature fixing ability cannot be maintained.

Again, if the glass transition point of the core particles is less than 40° C., change of shape, disintegration, or fusing of the toner particles to the carrier, etc. due, for example, to heat stress in the developing vessel during successive copying causes deterioration of the friction charging member. This, in turn, leads to impairment of image quality, and the toner's stability over time cannot be maintained. Further, in some cases, fusing of the toner particles causes the developing agent to become solidified and lock in the developing vessel.

On the other hand, if the glass transition point of the core particles is more than 65° C., low-temperature fixing ability is impaired. Further, the compatibility of the core particles and the fine polymer particles is reduced, and the film of fine polymer particles formed on the surface of the core particles by fusing of the core particles and the fine polymer particles will be insufficiently strong.

Incidentally, in the first embodiment above and in the present embodiment, the glass transition point of the fine polymer particles (or of the organic surface-modifying fine particles) is their intermediate glass transition point (midpoint glass transition temperature) measured in accordance with the heat flux differential scanning calorimetry method stipulated in Japanese Industrial Standards K 7121-1987 and ASTM 3418-82 using a differential scanning calorimeter (Seiko Electronic Industries Co., Ltd. product DCS220 Model).

By being affixed or formed into a film on the surface of the core particles, the fine polymer particles according to the present embodiment form a thin film, and in this way perform the function of protecting the core particles without impairing their functions. For this reason, if the average particle diameter by volume of the fine polymer particles is too large, they will not be able to perform this function.

Accordingly, it is preferable if the average particle diameter by volume of the fine polymer particles according to the present embodiment is within a range from 0.05 μm through 5.0 μm, and more preferable if it is within a range from 0.05 μm to 1.0 μm. Further, it is preferable if the average particle diameter by volume of the fine polymer particles is no more than 1/5 of that of the core particles, and more preferable if it is no more than 1/20 of that of the core particles.

The quantity of fine polymer particles included in the toner according to the present embodiment should preferably be, by weight, from 0.1 part to 15 parts by weight for 100 parts by weight of the core particles, for the same reasons as in the case of the quantity of the organic surface-modifying fine particles in the toner according to the first embodiment.

The core particles in the present embodiment include binder resin and a colorant. For the binder resin, the examples of materials cited in the first embodiment may be used. Again, for the colorant, any well-known material may be used, such as carbon black, iron black, nigrosine; benzine yellow, quinacridone, rhodamine B, and phthalocyanine blue. In the core particles, the quantity of colorant added should preferably be within a range from 3 to 12 parts by weight for 100 parts by weight of the binder resin.

In addition, a magnetic powder may be added to the core particles in order to use the toner as a magnetic developing agent. For this magnetic powder, a powder of a material which is magnetized when placed in a magnetic field may be used, for example a powder of a ferromagnetic metal such as iron, cobalt, or nickel, or a powder of a ferromagnetic metal oxide such as magnetite, hematite, or ferrite.

Further, in order to prevent offset at the time of toner fixing and to improve the fixing characteristics and developing characteristics of the toner, a mold release agent may be added to the core particles. For this mold release agent, an ethylene-based olefin polymer with low molecular weight may be used, such as polyethylene, polypropylene, ethylene-propylene copolymer, ethylene-vinyl acetate copolymer, ethylene-ethyl acrylic copolymer, and an ionomer having a polyethylene structure. Incidentally, "low molecular weight" generally means a weight-average molecular weight of 10,000 or less.

The quantity of mold-release agent added should preferably be within a range from 0.1 part to 5 parts by weight for 100 parts by weight of the toner as a whole, more preferably within a range from 0.2 part to 3 parts by weight. Adding less than 0.1 part by weight of the mold-release agent results in less improvement of the toner's fixing characteristics and developing characteristics. Again, adding more than 5 parts by weight of the mold-release agent increases the toner's tendency to aggregate, thus reducing the toner's fluidity.

The particle diameter of the core particles may be the same as that of generally used toner particles; an average particle diameter by volume within a range from 5 $\mu$m to 15 $\mu$m is suitable.

The toner according to the present embodiment, like that in the first embodiment, is manufactured by first attaching and dispersing the fine polymer particles on the surface of the core particles, and then exposing these combined particles to a hot air flow.

In heat processing in the hot air flow, the temperature applied to the fine polymer particles and to the surface of the core particles is at or above the softening point of these respective particles, but the temperature applied to the interior of the core particles is not sufficient to soften the core particles. Accordingly, the fine polymer particles are fused with the surface of the core particles, thus being affixed or formed into a film thereon, while maintaining the irregular shape of the core particles.

In regard to the attachment and dispersal of the fine polymer particles on the surface of the core particles, combined particles in an ordered mixture may be obtained by stirring the fine polymer particles and core particles in a stirring device such as a Henschel mixer, thereby dispersing and attaching the fine polymer particles on the surface of the core particles by van der Waals force and electrostatic force.

Heat processing in the hot air flow may be performed using the heat processing device shown in FIG. 2 in the same manner as in the first embodiment, but in the present embodiment, the temperature of the hot air flow is within a range from 150° C. through 400° C.

In processing in the hot air flow, if the temperature of the hot air flow is less than 150° C., the fine polymer particles cannot be sufficiently filmed. As a result, separation, peeling, and floating of the fine polymer particles occurs due, for example, to mechanical stress in the developing vessel during successive copying, which impairs image quality. In other words, the toner's stability over time is impaired. Again, if the temperature of the hot air flow is more than 400° C., the core particles are made spherical, which causes poor cleaning. At such a temperature, fusing and aggregation of toner particles also occurs during heat processing, making it difficult to obtain a toner with a predetermined particle diameter.

Further, since the toner particles also fuse to the interior of the heat processing device, yield is decreased, and manufacturing problems arise. In order to ensure that the core particles do not become spherical, it is preferable to perform heat processing in the hot air flow instantaneously (no longer than 1 second).

The toner according to the present embodiment may also be manufactured by dispersing and attaching the fine polymer particles on the surface of the core particles, and then applying mechanical impact force to the dispersed and attached fine polymer particles. The method of applying mechanical impact force should preferably be one which applies impact force in a high-speed air flow using a device such as the Hybridization System (Nara Machinery Manufacturing Co., Ltd. product) or the Cosmos System (Kawasaki Heavy Industries Co., Ltd. product), because this method is suitable for particles of small particle diameter, and because there is little heat accumulation.

Incidentally, the toners according to the first embodiment above and the present embodiment may be used as one-component electrophotographic developing agents, or they may, as necessary, be mixed with carrier particles such as iron powder, ferrite powder, magnetite powder, glass beads, or nickel powder, and used in a two-component developing electrophotographic agent (for forming electrostatic latent images). Again, in order to improve the free flowing of the powder, these toners may be mixed with polishing agent particles such as a fine powder of silica in hydrophobic colloid form, a fine powder of titanium oxide, or magnetite.

The well-known heat roller fixing method may be used for fixing the toners according to the present invention to the transfer material.

The following will explain in detail concrete examples according to the present embodiment as concrete examples 7 through 23, and comparative examples as comparative examples 1 through 9.

(CONCRETE EXAMPLE 7)

First, by weight, 100 parts styrene-acrylic copolymer binder resin, 6 parts carbon black as colorant, and 3 parts low molecular weight polypropylene as mold-release agent were melted and kneaded at a temperature of 150° C. using a two-shaft extruding kneader provided with a toner material supply section. After cooling the melted, kneaded mixture, it was first coarsely ground using a feather mill, and then ground and separated in a jet mill (Japan Pneumatic Industries Co., Ltd. product), yielding core particles (A) 10 $\mu$m in average diameter. The glass transition point of the core particles (A) was 55° C.

Then, by soap-free emulsion polymerization of, by weight, 50 parts methyl methacrylate (MMA) as the methacrylic alkylester and 50 parts isobutylmethacrylate (iso-BMA), fine polymer particles (a) were obtained. The fine polymer particles (a) had a weight-average molecular weight of 120,000, an average particle diameter by volume of 0.2 $\mu$m, and a glass transition point of 85° C.

Next, by weight, 100 parts core particles (A) and 5 parts fine polymer particles (a) were stirred in a Henschel-type mixer at a stirring speed of 1500 rpm for 30 minutes. In this way, the fine polymer particles (a) were dispersed over and attached to the surface of the core particles (A) by van der Waals force and electrostatic force, yielding an ordered mixture.

Then, using a hot air flow surface modification device (Japan Pneumatic Industries Co., Ltd. product Suffusing System), toner (1) was obtained by processing the ordered mixture in a hot air flow of 300° C. for approximately 1 second. The yield of the heat processing step in the hot air flow surface modification device was 97%.

The toner (1) obtained was then put in an electrophotographic copy machine (Sharp Co. product SF-2027), and image quality was evaluated after copying of 50,000 sheets, and again after copying of 80,000 sheets. The results of both evaluations were good.

Image quality was evaluated on a three-stage scale of "Good," "Fair", (limit of acceptability for use), and "Poor." In other words, image quality not differing greatly from that in the initial stage of copying was evaluated as "Good," image quality slightly inferior to initial image quality but within acceptable limits for use was evaluated as "Fair," and image quality clearly inferior to initial image quality and unsuitable for actual use was evaluated as "Poor."

Further, when the above-mentioned copier was examined for poor cleaning after copying of 80,000 copies using toner (1), no poor cleaning whatsoever had occurred.

In addition, when storage stability was evaluated by filling the toner cartridge of the above-mentioned electrophotographic copy machine with 320 g of toner (1), letting stand for 2 weeks at 45° C., and then examining for blocking (presence or absence of lumps of toner particles), the result was good. Storage stability was evaluated as follows. When there was no blocking, and copy image quality was also good, the evaluation was "Good," and when there were shortcomings such as blocking or poor copy image quality, the evaluation was "Poor."

Further, a rubbing test was performed using a sand eraser (Lion Co., Ltd. product ER-502K) in a device for testing fastness to rubbing, and the percentage of fixed toner (1) remaining after rubbing (fixing percentage) was measured, resulting in a satisfactory measurement of 93%. Since a percentage remaining (fixing percentage) of 80% or better is satisfactory for actual use, a percentage of 80% or better was judged "Satisfactory," and a percentage of less than 80% was judged "Unsatisfactory."

Finally, when toner (1) was rated overall on a four-stage scale of "○○," "○," "X," "XX," toner (1) was rated ○○. This overall rating was made as follows. If image quality after 50,000 and after 80,000 copies and storage stability were both Good, there was no poor cleaning, and the fixing percentage was 90% or better, the toner was rated "○○ overall; if, overall, the toner was considered acceptable for actual use in a copy machine, but image evaluation after 50,000 and after 80,000 copies was somewhat inferior, or the fixing percentage was more than 80% but less than 90%, the toner was rated "○" overall; and if at least one of image quality after 50,000 and after 80,000 copies, storage stability, presence/absence of poor cleaning, and fixing percentage was Poor, the toner was rated "X" or "XX" overall. Further, "X" and "XX" were distinguished as follows. If the toner did not possess the minimum characteristics necessary for actual use in a copy machine, and it was judged that the toner would be unacceptable to users, the toner was rated "XX" overall; and in other cases the toner was rated "X" overall.

(CONCRETE EXAMPLE 8)

A toner (2) was prepared in the same manner as in concrete example 7, except that fine polymer particles (b) were used instead of the fine polymer particles (a). The fine polymer particles (b) were prepared by soap-free emulsion polymerization of, by weight, 50 parts methyl methacrylate and 50 parts isobutylmethacrylate. The fine polymer particles (b) had a weight-average molecular weight of 30,000, an average particle diameter by volume of 0.2 μm, and a glass transition point of 81° C.

(CONCRETE EXAMPLE 9)

A toner (3) was prepared in the same manner as in concrete example 7, except that fine polymer particles (c) were used instead of the fine polymer particles (a). The fine polymer particles (c) were prepared by soap-free emulsion polymerization of, by weight, 50 parts methyl methacrylate and 50 parts isobutylmethacrylate. The fine polymer particles (c) had a weight-average molecular weight of 50,000, an average particle diameter by volume of 0.2 μm, and a glass transition point of 83° C.

(CONCRETE EXAMPLE 10)

A toner (4) was prepared in the same manner as in concrete example 7, except that fine polymer particles (d) were used instead of the fine polymer particles (a). The fine polymer particles (d) were prepared by soap-free emulsion polymerization of, by weight, 50 parts methyl methacrylate and 50 parts isobutylmethacrylate. The fine polymer particles (d) had a weight-average molecular weight of 200,000, an average particle diameter by volume of 0.2 μm, and a glass transition point of 86° C.

(CONCRETE EXAMPLE 11)

A toner (5) was prepared in the same manner as in concrete example 7, except that fine polymer particles (e) were used instead of the fine polymer particles (a). The fine polymer particles (e) were prepared by soap-free emulsion polymerization of, by weight, 50 parts methyl methacrylate and 50 parts isobutylmethacrylate. The fine polymer particles (e) had a weight-average molecular weight of 800,000, an average particle diameter by volume of 0.2 μm, and a glass transition point of 87° C.

(Comparative Example 1)

A toner (6) was prepared in the same manner as in concrete example 7, except that fine polymer particles (f) were used instead of the fine polymer particles (a). The fine polymer particles (f) were prepared by soap-free emulsion polymerization of, by weight, 50 parts methyl methacrylate and 50 parts isobutylmethacrylate. The fine polymer particles (f) had a weight-average molecular weight of 29,000, an average particle diameter by volume of 0.2 μm, and a glass transition point of 80° C.

(Comparative Example 2)

A toner (7) was prepared in the same manner as in concrete example 7, except that fine polymer particles (g) were used instead of the fine polymer particles (a). The fine polymer particles (g) were prepared by soap-free emulsion polymerization of, by weight, 50 parts methyl methacrylate and 50 parts isobutylmethacrylate. The fine polymer particles (g) had a weight-average molecular weight of 810,000, an average particle diameter by volume of 0.2 μm, and a glass transition point of 87° C.

(Comparative Example 3)

A toner (8) was prepared in the same manner as in comparative example 2, except that the temperature of heat processing of the core particles (A) and the fine polymer particles (g) in the hot air flow surface modification device (Suffusing System) was changed to 450° C.

Table 10 shows the toner manufacturing conditions for the toners (2) through (8). In addition, Table 11 shows the results of evaluation of the toners (2) through (8) in the same manner as the foregoing evaluation of toner (1), along with the results of evaluation of toner (1).

TABLE 10

| | | FINE POLYMER PARTICLES | | | | CORE PARTICLES | | SURFACE MODIFICATION DEVICE | |
|---|---|---|---|---|---|---|---|---|---|
| | TONER NAME | NAME | TYPE | WEIGHT-AV. MOLECULAR WEIGHT (Mw) | GLASS TRANSITION POINT (° C.) | NAME | GLASS TRANSITION POINT (° C.) | NAME | HOT AIR FLOW TEMP. |
| CONCRETE EXAMPLE 7 | (1) | (a) | MMA/iso-BMA COPOLYMER | 120,000 | 85 | (A) | 55 | SUFFUSING SYSTEM | 300 |
| CONC. EX. 8 | (2) | (b) | MMA/iso-BMA COPOLYMER | 30,000 | 81 | (A) | 55 | SUFFUSING SYSTEM | 300 |
| CONC. EX. 9 | (3) | (c) | MMA/iso-BMA COPOLYMER | 50,000 | 83 | (A) | 55 | SUFFUSING SYSTEM | 300 |
| CONC. EX. 10 | (4) | (d) | MMA/iso-BMA COPOLYMER | 200,000 | 86 | (A) | 55 | SUFFUSING SYSTEM | 300 |
| CONC. EX. 11 | (5) | (e) | MMA/iso-BMA COPOLYMER | 800,000 | 87 | (A) | 55 | SUFFUSING SYSTEM | 300 |
| COMPARATIVE EXAMPLE 1 | (6) | (f) | MMA/iso-BMA COPOLYMER | 29,000 | 80 | (A) | 55 | SUFFUSING SYSTEM | 300 |
| COMP. EX. 2 | (7) | (g) | MMA/iso-BMA COPOLYMER | 810,000 | 90 | (A) | 55 | SUFFUSING SYSTEM | 300 |
| COMP. EX. 3 | (8) | (g) | MMA/iso-BMA COPOLYMER | 810,000 | 90 | (A) | 55 | SUFFUSING SYSTEM | 450 |

TABLE 11

| | IMAGE QUALITY EVALUATION RESULTS | | | STORAGE STABILITY | FIXING PERCENTAGE | | |
|---|---|---|---|---|---|---|---|
| | AFTER 50,000 COPIES | AFTER 80,000 COPIES | POOR CLEANING | (45° C., 2 WEEKS) | FIXING PERCENTAGE (%) | SATISFACTORY/ UNSATISFACTORY | OVERALL RATING |
| CONCRETE EXAMPLE 7 | GOOD | GOOD | NO | GOOD | 93 | SATISFACTORY | ○○ |
| CONC. EX. 8 | GOOD | FAIR | NO | GOOD | 94 | SATISFACTORY | ○ |
| CONC. EX. 9 | GOOD | GOOD | NO | GOOD | 92 | SATISFACTORY | ○○ |
| CONC. EX. 10 | GOOD | GOOD | NO | GOOD | 91 | SATISFACTORY | ○○ |
| CONC. EX. 11 | GOOD | GOOD | NO | GOOD | 82 | SATISFACTORY | ○ |
| COMPARATIVE EXAMPLE 1 | POOR | POOR | NO | GOOD | 95 | SATISFACTORY | X |
| COMP. EX. 2 | POOR | POOR | NO | GOOD | 78 | UNSATISFACTORY | X |
| COMP. EX. 3 | POOR | POOR | YES | GOOD | 77 | UNSATISFACTORY | XX |

(CONCRETE EXAMPLE 12)

First, fine polymer particles (h) were obtained by soap-free emulsion polymerization of, by weight, 15 parts methylacrylate (MA) as the acrylic alkylester and 85 parts styrene (St). The fine polymer particles (h) had a weight-average molecular weight of 119,000, an average particle diameter by volume of 0.2 μm, and a glass transition point of 83° C.

Then, a toner (9) was prepared in the same manner as in concrete example 7, except that the fine polymer particles (h) were used instead of the fine polymer particles (a).

(CONCRETE EXAMPLE 13)

First, fine polymer particles (i) were obtained by soap-free emulsion polymerization of, by weight, 15 parts ethylacrylate (EA) as the acrylic alkylester and 85 parts styrene. The fine polymer particles (i) had a weight-average molecular weight of 125,000, an average particle diameter by volume of 0.2 μm, and a glass transition point of 75° C.

Then, a toner (10) was prepared in the same manner as in concrete example 7, except that the fine polymer particles (i) were used instead of the fine polymer particles (a).

(CONCRETE EXAMPLE 14)

First, fine polymer particles (j) were obtained by soap-free emulsion polymerization of, by weight, 15 parts n-butylacrylate (BA) as the acrylic alkylester and 85 parts styrene. The fine polymer particles (j) had a weight-average molecular weight of 122,000, an average particle diameter by volume of 0.2 μm, and a glass transition point of 67° C.

Then, a toner (11) was prepared in the same manner as in concrete example 7, except that the fine polymer particles (j) were used instead of the fine polymer particles (a).

(CONCRETE EXAMPLE 15)

First, fine polymer particles (k) were obtained by soap-free emulsion polymerization of, by weight, 40 parts ethylmethacrylate (EMA) as the acrylic alkylester and 60 parts styrene. The fine polymer particles (k) had a weight-average molecular weight of 125,000, an average particle diameter by volume of 0.2 μm, and a glass transition point of 82° C.

Then, a toner (12) was prepared in the same manner as in concrete example 7, except that the fine polymer particles (k) were used instead of the fine polymer particles (a).

(CONCRETE EXAMPLE 16)

First, fine polymer particles (1) were obtained by soap-free emulsion polymerization of, by weight, 30 parts butylmethacrylate (BMA) as the acrylic alkylester and 70 parts styrene. The fine polymer particles (1) had a weight-average molecular weight of 130,000, an average particle diameter by volume of 0.2 μm, and a glass transition point of 70° C.

Then, a toner (13) was prepared in the same manner as in concrete example 7, except that the fine polymer particles (1) were used instead of the fine polymer particles (a).

(CONCRETE EXAMPLE 17)

First, fine polymer particles (m) were obtained by soap-free emulsion polymerization of, by weight, 20 parts n-butylmethacrylate (BMA) and 80 parts isobutylmethacrylate. The fine polymer particles (m) had a weight-average molecular weight of 122,000, an average particle diameter by volume of 0.2 μm, and a glass transition point of 58° C.

Then, a toner (14) was prepared in the same manner as in concrete example 7, except that the fine polymer particles (m) were used instead of the fine polymer particles (a).

(CONCRETE EXAMPLE 18)

First, fine polymer particles (n) were obtained by soap-free emulsion polymerization of, by weight, 95 parts methylmethacrylate and 5 parts styrene. The fine polymer particles (n) had a weight-average molecular weight of 124,000, an average particle diameter by volume of 0.2 μm, and a glass transition point of 100° C.

Then, a toner (15) was prepared in the same manner as in concrete example 7, except that the fine polymer particles (n) were used instead of the fine polymer particles (a).

(Comparative Example 4)

First, fine polymer particles (o) were obtained by soap-free emulsion polymerization of, by weight, 20 parts n-butylmethacrylate and 80 parts isobutylmethacrylate. The fine polymer particles (o) had a weight-average molecular weight of 122,000, an average particle diameter by volume of 0.2 μm, and a glass transition point of 56° C.

Then, a toner (16) was prepared in the same manner as in concrete example 7, except that the fine polymer particles (o) were used instead of the fine polymer particles (a).

(Comparative Example 5)

First, fine polymer particles (p) were obtained by soap-free emulsion polymerization of, by weight, 95 parts methylmethacrylate and 5 parts styrene. The fine polymer particles (p) had a weight-average molecular weight of 124,000, an average particle diameter by volume of 0.2 μm, and a glass transition point of 105° C.

Then, a toner (17) was prepared in the same manner as in concrete example 7, except that the fine polymer particles (p)) were used instead of the fine polymer particles (a).

Table 12 shows the toner manufacturing conditions for the toners (1) and (9) through (17). In addition, Table 13 shows the results of evaluation of the toners (9) through (17) in the same manner as the foregoing evaluation of toner (1), along with the results of evaluation of toner (1).

TABLE 12

| | | FINE POLYMER PARTICLES | | | | CORE PARTICLES | | SURFACE MODIFICATION DEVICE | |
|---|---|---|---|---|---|---|---|---|---|
| | TONER NAME | NAME | TYPE | WEIGHT-AV. MOLECULAR WEIGHT (Mw) | GLASS TRANSITION POINT (° C.) | NAME | GLASS TRANSITION POINT (° C.) | NAME | HOT AIR FLOW TEMP. |
| CONCRETE EXAMPLE 7 | (1) | (a) | MMA/iso-BMA COPOLYMER | 120,000 | 85 | (A) | 55 | SUFFUSING SYSTEM | 300 |
| CONC. EX. 12 | (9) | (h) | MA/St COPOLYMER | 119,000 | 83 | (A) | 55 | SUFFUSING SYSTEM | 300 |
| CONC. EX. 13 | (10) | (i) | EA/St COPOLYMER | 125,000 | 75 | (A) | 55 | SUFFUSING SYSTEM | 300 |
| CONC. EX. 14 | (11) | (j) | BA/St COPOLYMER | 122,000 | 67 | (A) | 55 | SUFFUSING SYSTEM | 300 |
| CONC. EX. 15 | (12) | (k) | EMA/St COPOLYMER | 125,000 | 82 | (A) | 55 | SUFFUSING SYSTEM | 300 |
| CONC. EX. 16 | (13) | (l) | BMA/St COPOLYMER | 130,000 | 76 | (A) | 55 | SUFFUSING SYSTEM | 300 |
| CONC. EX. 17 | (14) | (m) | BMA/iso-BMA COPOLYMER | 122,000 | 58 | (A) | 55 | SUFFUSING SYSTEM | 300 |
| CONC. EX. 18 | (15) | (n) | MMA/St COPOLYMER | 124,000 | 100 | (A) | 55 | SUFFUSING SYSTEM | 300 |
| COMPARATIVE EXAMPLE 4 | (16) | (o) | BMA/iso-BMA COPOLYMER | 122,000 | 56 | (A) | 55 | SUFFUSING SYSTEM | 300 |
| COMP. EX. 5 | (17) | (p) | MMA/St COPOLYMER | 124,000 | 105 | (A) | 55 | SUFFUSING SYSTEM | 300 |

TABLE 13

| | IMAGE QUALITY EVALUATION RESULTS | | | STORAGE STABILITY | FIXING PERCENTAGE | | |
|---|---|---|---|---|---|---|---|
| | AFTER 50,000 COPIES | AFTER 80,000 COPIES | POOR CLEANING | (45° C., 2 WEEKS) | FIXING PERCENTAGE (%) | SATISFACTORY/ UNSATISFACTORY | OVERALL RATING |
| CONCRETE EXAMPLE 7 | GOOD | GOOD | NO | GOOD | 93 | SATISFACTORY | ○○ |
| CONC. EX. 12 | GOOD | GOOD | NO | GOOD | 92 | SATISFACTORY | ○○ |
| CONC. EX. 13 | GOOD | GOOD | NO | GOOD | 91 | SATISFACTORY | ○○ |
| CONC. EX. 14 | GOOD | GOOD | NO | GOOD | 93 | SATISFACTORY | ○○ |
| CONC. EX. 15 | GOOD | GOOD | NO | GOOD | 90 | SATISFACTORY | ○○ |
| CONC. EX. 16 | GOOD | GOOD | NO | GOOD | 92 | SATISFACTORY | ○○ |
| CONC. EX. 17 | GOOD | GOOD | NO | GOOD | 95 | SATISFACTORY | ○○ |
| CONC. EX. 18 | GOOD | GOOD | NO | GOOD | 87 | SATISFACTORY | ○○ |
| COMPARATIVE EXAMPLE 4 | POOR | POOR | NO | POOR | 95 | SATISFACTORY | XX |
| COMP. EX. 5 | POOR | POOR | NO | GOOD | 79 | UNSATISFACTORY | XX |

(CONCRETE EXAMPLE 19)

First, core particles (B) were obtained by the same method as in concrete example 7, using, by weight, 100 parts styrene-acrylic copolymer binder resin, 6 parts carbon black, and 3 parts low molecular weight polypropylene. The core particles (B) had a glass transition point of 40° C. and an average particle diameter by volume of 10 μm. Then, a toner (18) was prepared in the same manner as in concrete example 7, except that the core particles (B) were used instead of the core particles (A).

(CONCRETE EXAMPLE 20)

First, core particles (C) were obtained by the same method as in concrete example 7, using, by weight, 100 parts styrene-acrylic copolymer binder resin, 6 parts carbon black, and 3 parts low molecular weight polypropylene. The core particles (C) had a glass transition point of 65° C. and an average particle diameter by volume of 10 μm. Then, a toner (19) was prepared in the same manner as in concrete example 7, except that the core particles (C) were used instead of the core particles (A).

(Comparative Example 6)

First, core particles (D) were obtained by the same method as in concrete example 7, using, by weight, 100 parts styrene-acrylic copolymer binder resin, 6 parts carbon black, and 3 parts low molecular weight polypropylene. The core particles (D) had a glass transition point of 38° C. and an average particle diameter by volume of 10 μm. Then, a toner (20) was prepared in the same manner as in concrete example 7, except that the core particles (D) were used instead of the core particles (A).

(Comparative Example 7)

First, core particles (E) were obtained by the same method as in concrete example 7, using, by weight, 100 parts styrene-acrylic copolymer binder resin, 6 parts carbon black, and 3 parts low molecular weight polypropylene. The core particles (E) had a glass transition point of 67° C. and an average particle diameter by volume of 10 μm. Then, a toner (21) was prepared in the same manner as in concrete example 7, except that the core particles (E) were used instead of the core particles (A).

Table 14 shows the toner manufacturing conditions for the toners (1) and (18) through (21). In addition, Table 15 shows the results of evaluation of the toners (18) through (21) in the same manner as the foregoing evaluation of toner (1), along with the results of evaluation of toner (1).

TABLE 14

| | | FINE POLYMER PARTICLES | | | | CORE PARTICLES | | SURFACE MODIFICATION DEVICE | |
|---|---|---|---|---|---|---|---|---|---|
| | TONER NAME | NAME | TYPE | WEIGHT-AV. MOLECULAR WEIGHT (Mw) | GLASS TRANSITION POINT (° C.) | NAME | GLASS TRANSITION POINT (° C.) | NAME | HOT AIR FLOW TEMP. |
| CONCRETE EXAMPLE 7 | (1) | (a) | MMA/iso-BMA COPOLYMER | 120,000 | 85 | (A) | 55 | SUFFUSING SYSTEM | 300 |
| CONCRETE EXAMPLE 19 | (18) | (a) | MMA/iso-BMA COPOLYMER | 120,000 | 85 | (B) | 40 | SUFFUSING SYSTEM | 300 |
| CONCRETE EXAMPLE 20 | (19) | (a) | MMA/iso-BMA COPOLYMER | 120,000 | 85 | (C) | 65 | SUFFUSING SYSTEM | 300 |
| COMPARATIVE EXAMPLE 6 | (20) | (a) | MMA/iso-BMA COPOLYMER | 120,000 | 85 | (D) | 38 | SUFFUSING SYSTEM | 300 |
| COMPARATIVE EXAMPLE 7 | (21) | (a) | MMA/iso-BMA COPOLYMER | 120,000 | 85 | (E) | 67 | SUFFUSING SYSTEM | 300 |

TABLE 15

| | IMAGE QUALITY EVALUATION RESULTS | | | STORAGE STABILITY | FIXING PERCENTAGE | | |
|---|---|---|---|---|---|---|---|
| | AFTER 50,000 COPIES | AFTER 80,000 COPIES | POOR CLEANING | (45° C., 2 WEEKS) | FIXING PERCENTAGE (%) | SATISFACTORY/ UNSATISFACTORY | OVERALL RATING |
| CONCRETE EXAMPLE 7 | GOOD | GOOD | NO | GOOD | 93 | SATISFACTORY | ○○ |
| CONCRETE EXAMPLE 19 | GOOD | GOOD | NO | GOOD | 98 | SATISFACTORY | ○○ |
| CONCRETE EXAMPLE 20 | GOOD | GOOD | NO | GOOD | 86 | SATISFACTORY | ○○ |
| COMPARATIVE EXAMPLE 6 | POOR | POOR | NO | GOOD | 97 | SATISFACTORY | X |
| COMPARATIVE EXAMPLE 7 | POOR | POOR | NO | GOOD | 79 | UNSATISFACTORY | XX |

(CONCRETE EXAMPLE 21)

A toner (22) was prepared in the same manner as in concrete example 7, except that the temperature of heat processing of the core particles (A) and the fine polymer particles (a) in the hot air flow of the hot air flow surface modification device (Suffusing System) was changed to 150° C. The yield of the heat processing step in the hot air flow surface modification device was 96%.

(CONCRETE EXAMPLE 22)

A toner (23) was prepared in the same manner as in concrete example 7, except that the temperature of heat processing of the core particles (A) and the fine polymer particles (a) in the hot air flow of the hot air flow surface modification device (Suffusing System) was changed to 400° C. The yield of the heat processing step in the hot air flow surface modification device was 90%.

(Comparative Example 8)

A toner (24) was prepared in the same manner as in concrete example 7, except that the temperature of heat processing of the core particles (A) and the fine polymer particles (a) in the hot air flow of the hot air flow surface modification device (Suffusing System) was changed to 140° C. The yield of the heat processing step in the hot air flow surface modification device was 96%.

(Comparative Example 9)

A toner (25) was prepared in the same manner as in concrete example 7, except that the temperature of heat processing of the core particles (A) and the fine polymer particles (a) in the hot air flow of the hot air flow surface modification device (Suffusing System) was changed to 410° C. The yield of the heat processing step in the hot air flow surface modification device was 81%.

(CONCRETE EXAMPLE 23)

First, an ordered mixture of the core particles (A) and the fine polymer particles (a) was prepared by means of the same operations as in concrete example 7. Then, using a Nara Machinery Manufacturing Co., Ltd. WS-1 Model Hybridization System, this ordered mixture was processed by means of mechanical impact force for 3 minutes at 6,000 rpm, yielding a toner (26). The yield of the mechanical impact force processing step was 89%.

Table 16 shows the toner manufacturing conditions for the toners (1) and (22) through (26). In addition, Table 17 shows the results of evaluation of the toners (22) through (26) in the same manner as the foregoing evaluation of toner (1), along with the results of evaluation of toner (1).

TABLE 16

| | | FINE POLYMER PARTICLES | | | | CORE PARTICLES | | SURFACE MODIFICATION DEVICE | | |
|---|---|---|---|---|---|---|---|---|---|---|
| | TONER NAME | NAME | TYPE | WEIGHT-AV. MOLECULAR WEIGHT (Mw) | GLASS TRANSITION POINT (° C.) | NAME | GLASS TRANSITION POINT (° C.) | NAME | HOT AIR FLOW TEMP | YIELD |
| CONCRETE EXAMPLE 7 | (1) | (a) | MMA/iso-BMA COPOLYMER | 120,000 | 85 | (A) | 55 | SUFFUSING SYSTEM | 300 | 97 |
| CONCRETE EXAMPLE 21 | (22) | (a) | MMA/iso-BMA COPOLYMER | 120,000 | 85 | (A) | 55 | SUFFUSING SYSTEM | 150 | 96 |
| CONCRETE EXAMPLE 22 | (23) | (a) | MMA/iso-BMA COPOLYMER | 120,000 | 85 | (A) | 55 | SUFFUSING SYSTEM | 400 | 90 |
| COMPARATIVE EXAMPLE 9 | (24) | (a) | MMA/iso-BMA COPOLYMER | 120,000 | 65 | (A) | 55 | SUFFUSING SYSTEM | 140 | 96 |

TABLE 16-continued

| | | FINE POLYMER PARTICLES | | | | CORE PARTICLES | | SURFACE MODIFICATION DEVICE | | |
|---|---|---|---|---|---|---|---|---|---|---|
| | TONER NAME | NAME | TYPE | WEIGHT-AV. MOLE-CULAR WEIGHT (Mw) | GLASS TRANSITION POINT (° C.) | NAME | GLASS TRANSITION POINT (° C.) | NAME | HOT AIR FLOW TEMP | YIELD |
| COMPARATIVE EXAMPLE 9 | (25) | (a) | MMA/iso-BMA COPOLYMER | 120,000 | 85 | (A) | 55 | SUFFUSING SYSTEM | 410 | 81 |
| CONCRETE EXAMPLE 23 | (26) | (a) | MMA/iso-BMA COPOLYMER | 120,000 | 85 | (A) | 55 | HYBRIDI-ZATION SYSTEM | — | 89 |

SURFACE MODIFICATION CONDITIONS FOR CONCRETE EXAMPLE 23 WERE 6,000 RPM FOR 3 MINUTES.

TABLE 17

| | IMAGE QUALITY EVALUATION RESULTS | | | STORAGE STABILITY | FIXING PERCENTAGE | | |
|---|---|---|---|---|---|---|---|
| | AFTER 50,000 COPIES | AFTER 80,000 COPIES | POOR CLEANING | (45° C., 2 WEEKS) | FIXING PERCENTAGE (%) | SATISFACTORY/ UNSATISFACTORY | OVERALL RATING |
| CONCRETE EXAMPLE 7 | GOOD | GOOD | NO | GOOD | 93 | SATISFACTORY | ○○ |
| CONCRETE EXAMPLE 21 | GOOD | GOOD | NO | GOOD | 94 | SATISFACTORY | ○○ |
| CONCRETE EXAMPLE 22 | GOOD | GOOD | NO | GOOD | 92 | SATISFACTORY | ○○ |
| COMPARATIVE EXAMPLE 8 | POOR | POOR | NO | GOOD | 95 | SATISFACTORY | X |
| COMPARATIVE EXAMPLE 9 | POOR | POOR | YES | GOOD | 90 | SATISFACTORY | X |
| CONCRETE EXAMPLE 23 | GOOD | GOOD | NO | GOOD | 93 | SATISFACTORY | ○ |

As has been discussed above, electrophotographic toner according to the present embodiment is made up of core particles which include binder resin and colorant, and fine polymer particles affixed or made into a film on the surface of the core particles, in which the weight-average molecular weight of the fine polymer particles is within a range from 30,000 through 800,000; the glass transition point of the fine polymer particles is higher than that of the core particles, that of the core particles being within a range from 40° C. through 65° C., and that of the fine polymer particles being within a range from 58° C. through 100° C.; and the toner is obtained by dispersing and attaching the fine polymer particles on the surface of the core particles, followed by exposure to a hot air flow of 150° C. to 400° C.

With the foregoing structure, since the weight-average molecular weight of the fine polymer particles is adjusted to within a range from 30,000 through 800,000, they have sufficient strength as-a shell to protect the core particles, and have superior compatibility with the core particles. As a result, by affixing or forming a film of the fine polymer particles, the fine polymer particles and core particles can be fused, and a strong film formed on the surface of the core particles, without making the irregularly-shaped core particles spherical.

Further, with the foregoing structure, since the toner particles are obtained by dispersing and attaching the fine polymer particles on the surface of the core particles, and then exposing these combined particles in a hot air flow of 150° C. to 400° C., the fine polymer particles and core particles can be sufficiently fused without making the irregularly-shaped core particles spherical.

As a result, problems such as filming, toner scattering, and image fogging, which are caused by separation, peeling, etc. of the fine polymer particles due to, for example, mechanical stress in the developing vessel during successive copying, can be prevented, thus improving stability over time (toner life during successive copying). Further, poor cleaning due to spherical toner particles can also be prevented.

In addition, since, in the foregoing electrophotographic toner, the glass transition point of the fine polymer particles is higher than that of the core particles, and the glass transition point of the core particles is within a range from 40° C. through 65° C., and that of the fine polymer particles is within a range from 58° C. through 100° C., the toner is capable of low-temperature fixing (low-energy fixing), and also has superior heat resistance, i.e., storage stability (anti-blocking) characteristics.

[Third Embodiment]

The following will explain the third embodiment of the present invention.

Figure 3:
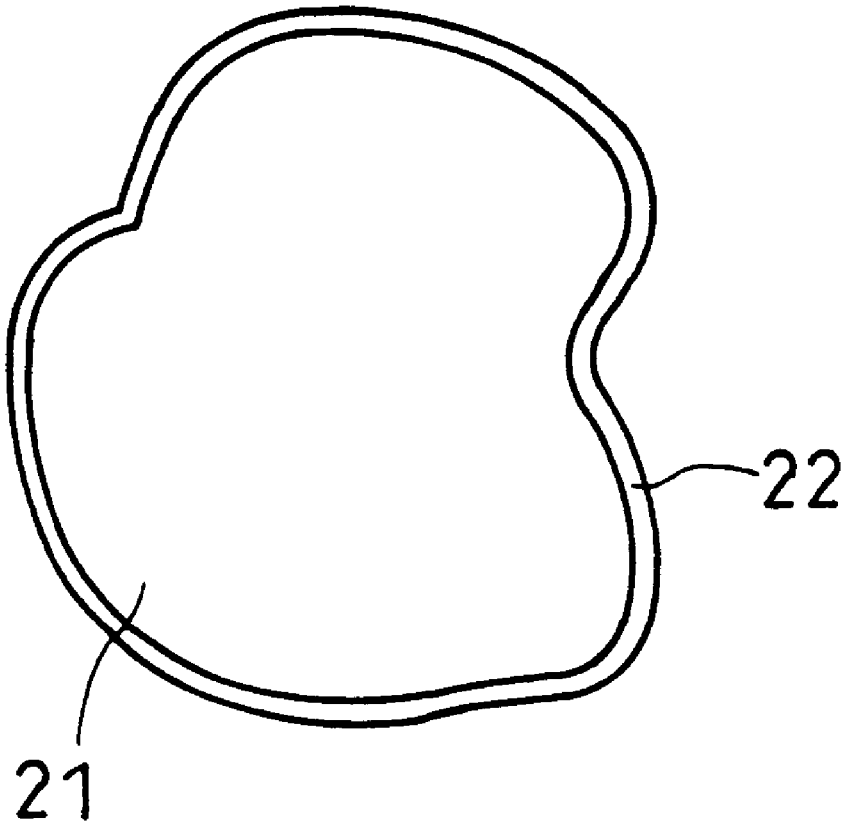
FIG. 3 is an explanatory drawing showing the structure of a particle of electrophotographic toner according to the third embodiment of the present invention.

FIG. 3 is an explanatory diagram showing a particle of electrophotographic toner (hereinafter referred to simply as "toner") according to the present embodiment. Each toner particle includes a core particle 21 and, as charge control agent, fine particles 22. As shown in FIG. 3, the fine particles 22 are uniformly dispersed over the surface of the core particle 21. Further, the core particle 21 does not include a charge control agent having a charge-imparting function, but does include at least colorant or binder resin.

The method of manufacturing this toner (hereinafter referred to as "the present manufacturing method") will be explained in detail below.

The present manufacturing method includes at least a core particle producing step and a fine particle affixing step, and performs external additive processing as necessary. The core particle producing step is a process in which the core particles 21 are produced by grinding, using at least a colorant and binder resin. The fine particle affixing step is performed after the core particle producing step, and is performed by means of dry processing. In this step, the fine particles 22, as charge control agent, are first dispersed over and attached to the surface of the core particles 21, and are then affixed or formed into a film thereon.

Here, "dry processing" means processing which does not include processing in a water-based or solvent-based liquid, or processing in which a liquid material is added (however, this does not include processing during the manufacturing process of resin-based materials, etc.).

In the present manufacturing method, by using various methods to affix various types of fine particles 22 to the core particles 21 in the fine particle affixing step, different toners with different properties may be prepared. These toner properties include, for example, fixing ability, high-temperature preservation, and charging quantity.

The following will explain the present manufacturing method in more detail.

First, the core particle producing step will be explained. As mentioned above, this step is a process in which the core particles 21 are produced by grinding, using at least a colorant and binder resin.

The core particle producing step is a process in which a mixing step, a kneading step, a cooling step, and a grinding step, to be discussed below, are performed in that order. In the mixing step, colorant, binder resin, and other necessary materials are uniformly mixed. In the kneading step performed thereafter, the mixture produced in the mixing step is heated, melted, and kneaded. Next, in the cooling step, the kneaded mixture produced is cooled. Then, in the grinding step, the kneaded mixture cooled in the cooling step is coarsely ground in a feather mill, finely ground in a jet mill, and then air separated. By means of these steps, core particles 21 of a desired particle diameter can be obtained.

The mixer to be used in the mixing step is not limited to any particular mixer, but may be, for example, a high-speed fluid-type mixer having stirring blades. High-speed fluid-type mixers include, for example, gravity-drop-type mixers such as a V-blender or ball mill, stirring-type mixers such as a Nauta mixer (such as that made by Hosokawa Micron Co., Ltd.), super mixers (such as that made by Kawata Co., Ltd.), and Henschel-type mixers (such as that made by Mitsui Miike Manufacturing Co., Ltd.). Again, mixing conditions in the mixer are not limited to any particular conditions.

For the kneading device to be used for heating, melting, and kneading in the kneading step, devices such as one- or two-shaft kneaders of the extruding type are suitable. Specific examples of such kneading devices include, but are not limited to, kneaders (such as that made by Georg Fischer Ltd.), TEM-type two-shaft kneaders (such as that made by Toshiba Machinery Co., Ltd.), KTK-type two-shaft kneaders (such as that made by Kobe Steel Co., Ltd.), and PCM-type two-shaft kneaders (such as that made by Ikegai Co., Ltd.). Again, kneading conditions in the kneading device are not limited to any particular conditions.

For the binder resin to be used as a material for the core particles 21, any well-known resin typically used in toner may be used. Specific examples of such resins include, but are not limited to, styrene-based resins such as polystyrene, polychlorostyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-acrylic copolymer, styrene-acrylic ester copolymer, styrene-methacrylic copolymer, styrene-methacrylic ester copolymer, styrene-α-chloroacrylic methyl copolymer, and styrene-acrylonitryl-acrylic ester copolymer; vinyl chloride resin; rosin denatured maleic acid resin; phenol resin; epoxy resin; saturated polyester resin; unsaturated polyester resin; polyethylene-based resins such as polyethylene and ethylene-acrylic ethyl copolymer; polypropylene resin; ionomer resin; polyurethane resin; silicone resin; ketone resin; xylene resin; polyvinyl-butyral resin; and polycarbonate resin.

The above-mentioned styrene resins are homopolymers or copolymers of styrene and its derivatives. Specific examples of styrene-acrylic ester copolymers include styrene-acrylic methyl copolymer, styrene-acrylic ethyl copolymer, styrene-acrylic butyl copolymer, styrene-acrylic octyl copolymer, and styrene-acrylic phenyl copolymer. Specific examples of styrene-methacrylic ester copolymers include styrene-methacrylic methyl copolymer, styrene-methacrylic ethyl copolymer, styrene-methacrylic butyl copolymer, styrene-methacrylic octyl copolymer, and styrene-methacrylic phenyl copolymer.

In the core particle producing step of the present manufacturing method, a single binder resin may be used, or two or more binder resins may be used. Among the binder resins listed above, styrene-based resins, saturated polyester resin, and unsaturated polyester resin are particularly suitable as the binder resin to be used as a material for the core particles 21. Again, the method of manufacturing the binder resin is not limited to any particular method.

For the colorant to be used as a material for the core particles 21, any well-known pigment or dye typically used in toner may be used. Specific examples of such colorants include, but are not limited to, inorganic pigments such as carbon black, iron black, Prussian blue, chrome yellow, titanium oxide, zinc white, alumina white, and calcium carbonate; organic pigments such as phthalocyanine blue, Victoria blue, phthalocyanine green, malachite green, hansa yellow G, benzine yellow, lake red C, and quinacridone magenta; organic dyes such as rhodamine dyes, triallyl methane dyes, anthraquinone dyes, monoazo dyes, and diazo dyes.

In the core particle producing step of the present manufacturing method, a single colorant may be used, or, according to the color to be given the toner, two or more colorants may be combined as needed. Colorants which have been pre-processed by a well-known method such as the so-called master batch method may be used.

Although the quantity of colorant to be used is not limited to any specific quantity, use of, by weight, from 1 part to 25 parts colorant for 100 parts binder resin is preferable, and use of 3 parts to 20 parts colorant by weight is even more preferable.

Next, the fine particle affixing step will be explained. As mentioned above, this step is a process in which, by means of dry processing, the fine particles 22, as charge control agent, are dispersed over and attached to the core particles 21, and then affixed or formed into a film thereon.

The fine particle affixing step is a process in which a uniform dispersal and attachment step and an affixing step are performed in that order. In the uniform dispersal and attachment step, the fine particles 22 are uniformly dispersed over the surface of the core particles 21, and attached thereto. In the affixing step, the attached fine particles 22 are affixed or formed into a film on the surface of the core particles 21.

The device to be used to disperse and attach the core particles 21 and the fine particles 22 in the uniform dispersal and attachment step of the fine particle affixing step may be, for example, a Mechano-mill (Okada Precision Industries product), a Mechanofusion System (Hosokawa Micron Co., Ltd. product), a Hybridization System (Nara Machinery Manufacturing Co., Ltd. product), or a Cosmos System (Kawasaki Heavy Industries Co., Ltd. product).

For the heat processing device to be used when the fine particles 22 are to be affixed to the core particles 21 by heat processing in the affixing step, a device capable of producing a hot air flow, such as the Suffusing System (Japan Pneumatic Industries Co., Ltd. product) may be used. In this case, it is preferable to use thermoplastic organic fine particles for the fine particles 22. If inorganic materials are used for the fine particles 22, it may be impossible to obtain desired charging characteristics in the affixing step or during use in a copy machine, etc., or the toner produced may lack charging stability. This is because the fine particles 22 become embedded in the core particles 21 due, for example, to stress applied in the developing vessel.

Further, fine particles made of inorganic materials have no compatibility with the core particles. Accordingly, these fine particles easily separate from the core particles. For this reason, problems such as image fogging are likely to arise. In contrast, when thermoplastic organic fine particles are used as the fine particles, the fine particles fuse with the binder resin of the core particles. Accordingly, if thermoplastic organic fine particles are used for the fine particles 22 in the present manufacturing method, they can be affixed more strongly to the core particles 21, and the problems mentioned above are less likely to occur.

When fine particles are to be attached to the surface of core particles, fine particles having a particle diameter of up to 1/10 of that of the core particles may generally be used. However, when, as in the present manufacturing method, fine particles are attached to the core particles as charge control agent, some fine particles in this particle diameter range are too large. If the particle diameter is too large, the attachment of the fine particles is insufficient, and they separate from the core particles. This leads to image fogging, filming phenomenon due to attachment of particles to the developing drum, etc. Investigation has shown that, for the present manufacturing method, in order to avoid these phenomena, the particle diameter of the fine particles 22 should preferably be no more than 1/20 of the diameter of the core particles 21.

Further, in order to use thermoplastic organic fine particles for the fine particles 22 in the present manufacturing method, they should preferably have a glass transition point $T_g$ within a range from 55° C. to 100° C. If the glass transition point $T_g$ is less than 55° C., storage stability (one of the basic characteristics of the toner) is impaired, and aggregation in storage due to mutual fusing of toner particles occurs. For this reason, when the toner is actually used, problems such as image fogging occur. Again, if the glass transition point $T_g$ is more than 100° C., heat processing will not result in sufficient fusing of the fine particles 21 and the core particles 22. As a result, the fine particles 21 will be likely to separate from the surface of the core particles 22. Accordingly, problems such as image fogging occur in this case as well.

Further, it is preferable if the thermoplastic organic fine particles have a weight-average molecular weight $M_w$ of 200,000 or less. If the weight-average molecular weight $M_w$ is more than 200,000, the thermo-plastic organic fine particles will be insufficiently melted by the quantity of heat applied at the time of fixing the toner to the paper. As a result, the strength of fixing of the toner to the paper will be insufficient, and the toner will separate or peel from the surface of the paper. Further, the smaller the weight-average molecular weight $M_w$, the more advantageous it is for fixing the toner to the paper. However, it is difficult to produce thermoplastic organic fine particles which have a weight-average molecular weight $M_w$ less than 50,000, but which also have a glass transition point $T_g$ within the range specified above.

As needed, external additive processing of the toner according to the present embodiment may also be carried out, in which well-known auxiliaries, external additives, mold-release agent, etc. generally used in toner are added. This external additive processing is performed in order to further improve the physical characteristics and heat characteristics of the toner, or to improve, for example, its fluidity or anti-aggregation.

Specific examples of auxiliaries include, but are not limited to, polyalkylene wax, parrafin wax, higher fatty acids, fatty acid amide, and metallic soaps. Specific examples of external additives include, but are not limited to, fine particles of a metallic oxide such as titania, silica, alumina, magnetite, or ferrite; fine particles of a synthetic resin such as acrylic-based resin or fluorine-based resin; and sodium hydrosulfite. Again, specific examples of mold-release agents include, but are not limited to polyethylene and polypropylene.

Although the quantity of auxiliary to be added is not limited to any specific quantity, adding, by weight, from 0.1 part to 10 parts auxiliary for 100 parts binder resin is preferable. Again, although the quantity of external additive to be added is not limited to any specific quantity, adding, by weight, from 0.01 part to 5 parts external additive for 100 parts binder resin is preferable. The method of adding the auxiliary, external additive, and/or mold-release agent to the toner is not limited to any particular method.

As discussed above, in the method of manufacturing electrophotographic toner according to the present embodiment, by producing core particles 21 of a common composition and by means of a common process, and then adding a desired charge control agent, electrophotographic toners with different properties may be prepared.

For this reason, a single production line for the core particles 21 is sufficient, and after the core particles 21 are produced, the fine particles merely need to be affixed by means of simple dry processing. Therefore, even when producing different types of electrophotographic toner, there is no need to provide separate production lines for the different types of toner. Further, since the fine particle affixing step is simple dry processing, there is little contamination of the interior of the manufacturing device. Thus, when producing different types of electrophotographic toner on a single production line, there is no need to perform thorough maintenance cleaning to remove remnants of previously produced toner from the manufacturing device; further, the amount of toner discarded at the time of cleaning can be held to a minimum. Accordingly, the manufacturing costs of the electrophotographic toner can be reduced.

The following will explain evaluative examples used in evaluative experiments carried out in order to verify the method of manufacturing electrophotographic toner according to the present embodiment and toner manufactured by means of this method. However, the electrophotographic toner and manufacturing method according to the present embodiment are not limited to the following evaluative examples.

The following evaluative examples made use of core particles A and B, each of which was produced by means of a different respective core particle producing step.

Core particles A are an example of core particles 21 produced by means of a core particle producing step which uses grinding. For the core particles A, the core particle producing step was performed as follows. First, by weight, 100 parts styrene-acrylic-based resin (softening point of 110° C., glass transition point $T_g$ of 55° C.), 8 parts carbon black (Cabot Corporation product 330R), and 2 parts low molecular weight polypropylene (Mitsui Petrochemical Industries Co., Ltd. product NP505) were mixed in a Henschel mixer, and then melted and kneaded at 150° C. in a two-shaft extruding-type kneader. After cooling this kneaded mixture by letting it stand, it was coarsely ground in a feather mill, finely ground in a jet mill, and air separated, thus producing core particles A with an average particle diameter of 10 $\mu$m.

Core particles B are an example of core particles 21 produced by means of a core particle producing step which uses polymerization. For the core particles B, the core particle producing step was performed as follows. First, a polymer composite was prepared by mixing in a sand stirrer, by weight, 90 parts styrene monomer, 10 parts acrylonitryl, 1 part di-vinylbenzene, and 2 parts benzoyl peroxide. This polymer composite was then introduced into a water solution of 10% potassium phosphate ($K_3PO_4$) by weight, which, using a TK Homo-mixer (Special Machinery Chemical Industries Co., Ltd. product), was first stirred at 4000 rpm for 3 minutes, and then allowed to react by heating at 80° C. and stirring at 100 rpm for 5 hours. The polymer particles thus obtained were acid washed, filtered, and dried, thus producing core particles B with an average particle diameter of 10 $\mu$m.

Next, toner samples T1 through T7 were prepared by means of the different respective fine particle affixing steps explained below.

First, the charge control agent, i.e., PMMA (polymethyl methacrylate) particles C1 and C2 used as the fine particles 22 according to the present embodiment, will be explained with reference to Table 18.

TABLE 18

| PMMA PARTICLES | COMPOSITION | AVERAGE PARTICLE DIAMETER [$\mu$m] | GLASS TRANSITION POINT $T_g$ [° C.] | AVERAGE MOLECULAR WEIGHT $M_w$ | QUANTITY ADDED [BY WEIGHT] | POLARITY |
|---|---|---|---|---|---|---|
| C1 | MMA | 0.2 | 72 | 150,000 | 5 PARTS | + |
| C2 | MMA | 0.2 | 70 | 140,000 | 5 PARTS | – |

As shown in Table 18, the PMMA particles C1 are fine particles composed of MMA (methyl methacrylate). They have an average particle diameter of 0.2 $\mu$m, a glass transition point $T_g$ of 72° C., a weight-average molecular weight $M_w$ of 150,000, and positive polarity. The PMMA particles C2 are fine particles composed of MMA (methyl methacrylate). They have an average particle diameter of 0.2 $\mu$m, a glass transition point $T_g$ of 70° C., a weight-average molecular weight $M_w$ of 140,000, and negative polarity.

In the fine particle affixing step for toner T1, 5 parts by weight of the PMMA particles C1 (which have the function of imparting a positive charge) were mixed with 100 parts by weight of the core particles A using a Mechano-mill (Okada Precision Industries Co., Ltd. product) under mixing conditions of 25° C., 2400 rpm, and 30 min, thus dispersing, attaching, and affixing the PMMA particles C1 on the surface of the core particles A.

The fine particle affixing step for toner T2 was performed in the same manner as that for toner T1, except that the PMMA particles C2 (which have the function of imparting a negative charge) were used instead of the PMMA particles C1.

The fine particle affixing step for toner T3 was performed in the same manner as that for toner T2, except that mixing in the Mechano-mill was temperature-controlled so that the mixing conditions were 60° C., 2400 rpm, and 30 min.

The fine particle affixing step for toner T4 was performed in the same manner as that for toner T2, except that the core particles B were used instead of the core particles A.

In the fine particle affixing step for toner T5, first, as a uniform dispersal and attachment step, 5 parts by weight of the PMMA particles C2 were mixed with 100 parts by weight of the core particles A using a Super-mixer (1Kawata Co., Ltd. product) under mixing conditions of 2000 rpm and 15 min, thus dispersing and attaching the PMMA particles C2 on the surface of the core particles A. Then, as an affixing step, the PMMA particles C2 were affixed on the surface of the core particles A by mechanical impact force using a Hybridization System (Nara Machinery Manufacturing Co., Ltd. product) under conditions of 6400 rpm and 3 min.

In the fine particle affixing step for toner T6, first, as a uniform dispersal and attachment step, 5 parts by weight of the PMMA particles Cl were mixed with 100 parts by weight of the core particles A using a Super-mixer under mixing conditions of 2000 rpm and 15 min, thus dispersing and attaching the PMMA particles C1 on the surface of the core particles A. Then, as an affixing step, the PMMA particles C1 were affixed or formed into a film on the surface of the core particles A by hot air processing (300° C.) using a Suffusing System (Japan Pneumatic Industries Co., Ltd. product), after which cooling was immediately performed by introducing cooled air (10° C.).

A heat processing device to be used in the fine particle affixing step for toner T6 is shown schematically in FIG. 2. This heat processing device is provided with a hot air producing device 11, a fixed quantity supplier 12, a cooling/recovery device 13, and a diffusion nozzle 14.

When performing processing using this heat processing device, surface-modifying fine particles like the fine particles 22 are first attached to the surface of irregularly-shaped core particles (composed chiefly of binder resin and obtained by a method such as grinding) like the core particles 21. Then, a predetermined quantity of combined particles, in which the fine particles are uniformly dispersed over the surface of the core particles, are supplied to the fixed quantity supplier 12 of the heat processing device. Incidentally, "irregular shape" means any shape other than a perfect sphere.

Next, these combined particles are sprayed, along with compressed air, from the fixed quantity supplier 12 through the diffusion nozzle 14 and into a hot air flow area A. The hot air flow area A is hot air produced by the hot air producing device 11, the temperature of which is adjusted to a predetermined level. In the hot air flow area A, heat energy is instantly applied to the combined particles. In producing toner T6, this temperature was set to 300° C. However, heat processing according to the present manufacturing method is not limited to this temperature.

Then, in order to affix or form a film of the fine particles on the surface of the core particles, the combined particles, to which the heat energy has been applied, are guided into the cooling/recovery device 13 and immediately cooled by cold air. In producing toner T6, the temperature of this cold air was adjusted to 10° C., but external air of normal temperature (approximately 25° C.), or cooled air adjusted to, a different temperature, may also be used.

The fine particle affixing step for toner T7 was performed in the same manner as that for toner T6, except that the PMMA particles C2 were used instead of the PMMA particles C1.

Toners T1 through T7 are surface-modified toners, but, as comparative examples of toners which are not surface-modified toners, toners TR1 and TR2 were prepared as follows.

For toner TR1, toner particles were prepared by adding, by weight, 2 parts charge control agent P-51 (Orient Chemical Industries Co., Ltd. product), which has the function of imparting a positive charge, at the time of mixing the materials in the core particle producing step for the core particles A, and then performing external additive processing of these toner particles.

Toner TR2 was produced in the same manner as toner TR1, except that charge control agent S-34 (Orient Chemical Industries Co., Ltd. product), which has the function of imparting a negative charge, was used instead of the charge control agent P-51.

All of the above-mentioned toners underwent external additive processing, as follows. For 100 parts toner particles by weight, 0.3 parts fine silica particles (Nippon Aerosil Co., Ltd. product R972) as fluidizing agent and 0.2 parts magnetite particles (Kanto Electrical Industries Co., Ltd. product KBC100) as drum surface polisher were added, and were then dispersed by mixing in a Super-mixer (Kawata Co., Ltd. product) at 2000 rpm for 2 minutes.

After external additive processing, ferrite carrier was mixed into each toner, yielding two-component developing agents. This mixing was performed by adding either a positive or negative carrier (each with average particle diameter of 80 $\mu$m), depending on the charge polarity of the toner, adjusting the quantities of the toner and the ferrite carrier so that the toner concentration was 4% by weight, and then stirring the two components in a V-type mixer for 15 minutes.

(Evaluative Experiment 1)

Using Sharp Co. copy machine SF-2027 (copy speed 27 sheets/min), 50,000 sheets were successively printed using each of the positive-charging toners T1, T6, and TR1, after which image fogging and poor cleaning were evaluated for each of these toners. The original used in copying had a ratio of black of 6%. The results of these evaluations are shown in Table 19. In Table 19, in the evaluation of image fogging, "○" indicates a good evaluation, "Δ" indicates that there was some fogging, but within acceptable limits for use, and "X" indicates a poor evaluation. Again, in the evaluation for poor cleaning, "○" indicates that there was no poor cleaning, and "X" indicates that poor cleaning occurred.

TABLE 19

| TONER EVALUATED | QUANTITY OF CHARGING [$\mu$c/g] | EVALUATION AFTER 50,000 COPIES | |
|---|---|---|---|
| | | IMAGE FOGGING | POOR CLEANING |
| T1 | 16.1 | ○ | ○ |
| T6 | 15.9 | ○ | ○ |
| TR1 | 15.3 | ○ | ○ |

IMAGE FOGGING EVALUATION: ○: GOOD Δ: SOME FOGGING, BUT WITHIN ACCEPTABLE LIMITS X: POOR
POOR CLEANING EVALUATION: ○: NO POOR CLEANING X: POOR CLEANING

As shown in Table 19, each of the toners evaluated had good copying characteristics.

(Evaluative Experiment 2)

Using Sharp Co. copy machine AR-5030 (copy speed 30 sheets/min), 50,000 sheets were successively printed using each of the negative-charging toners T2 through T5, T7, and TR2, after which image fogging and poor cleaning were evaluated for each of these toners. The original used in copying had a ratio of black of 6%. The results of these evaluations are shown in Table 20. Here, the methods of making the evaluations in the Table are the same as in Evaluative Experiment 1 above.

TABLE 20

| TONER EVALUATED | QUANTITY OF CHARGING [$\mu$c/g] | EVALUATION AFTER 50,000 COPIES | |
|---|---|---|---|
| | | IMAGE FOGGING | POOR CLEANING |
| T2 | 16.1 | ○ | ○ |
| T3 | 15.2 | ○ | ○ |
| T4 | 18.0 | ○ | ○ |
| T5 | 10.9 | Δ | ○ |
| T7 | 15.2 | ○ | ○ |
| TR2 | 16.5 | ○ | ○ |

IMAGE FOGGING EVALUATION: ○: GOOD Δ: SOME FOGGING, BUT WITHIN ACCEPTABLE LIMITS X: POOR
POOR CLEANING EVALUATION: ○: NO POOR CLEANING X: POOR CLEANING

As shown in Table 20, each of the toners evaluated had good charging characteristics, except that toner T5, which was produced by mechanical impact force, had a lower quantity of charging than the others, leading to some image fogging, but within acceptable limits.

This is due to phenomena such as embedding of the PMMA particles in the core particles and change of the shape of pointed areas on the surface of the core particles, which are due to mechanical impact, and which result in covering of the PMMA particles of charge control agent by the material forming the core particles.

(Evaluative Experiment 3)

Using Sharp Co. copy machine SD-3076 (copy speed 76 sheets/min), 100,000 sheets were successively printed using each of the negative-charging toners T2 through T5, T7, and TR2, after which image fogging and poor cleaning were evaluated for each of these toners. The original used in copying had a ratio of black of 6%. The results of these evaluations are shown in Table 21. Here, the methods of making the evaluations in the Table are the same as in Evaluative Experiment 1 above.

TABLE 21

| TONER EVALUATED | QUANTITY OF CHARGING [μc/g] | EVALUATION AFTER 100,000 COPIES | |
|---|---|---|---|
| | | IMAGE FOGGING | POOR CLEANING |
| T2 | 18.9 | X | ○ |
| T3 | 18.5 | Δ | ○ |
| T4 | 19.8 | ○ | X |
| T5 | 13.1 | Δ | ○ |
| T7 | 18.2 | ○ | ○ |
| TR2 | 18.4 | ○ | ○ |

IMAGE FOGGING EVALUATION: ○: GOOD Δ: SOME FOGGING, BUT WITHIN ACCEPTABLE LIMITS X: POOR
POOR CLEANING EVALUATION: ○: NO POOR CLEANING X: POOR CLEANING

As shown in Table 21, image fogging occurred with toner T2. In toner T2, as mentioned above, the PMMA particles C2 are dispersed, attached, and affixed on the surface of the core particles A by processing at normal temperature in a Mechano-mill. The ability of the Mechano-mill to perform this dispersal, attachment, and affixing is comparatively weak.

Again, some image fogging occurred with toner T3, in which dispersal, attachment, and affixing were performed by processing at a controlled temperature in a Mechano-mill, and with toner T5, in which affixing was performed by means of mechanical impact force. In the case of toner T3, as with toner T2, the cause of image fogging is the rather weak attachment and affixing of the PMMA particles to the surface of the core particles. In the case of toner T5, it is due to the fact that the quantity of charging is somewhat lower than in the other toners.

Further, poor cleaning occurred with toner T4, which used spherical core particles obtained by polymerization. This is chiefly due to insufficient attachment of untransferred toner to the cleaning brush, which is caused by insufficient friction and attachment due to the spherical shape of the core particles.

In contrast, good copying characteristics were obtained with toner T7, which was heat processed and then cooled immediately thereafter.

The results of the foregoing evaluations show that a toner like toner T7 is preferable when using, as in the present Evaluative Experiment, a high-speed copy machine which applies high stress in the developing vessel. As discussed above, toner T7 was produced by means of a fine particle affixing step in which a device like that shown in FIG. 2 was used for high-temperature heat processing immediately followed by cooling. Further, the foregoing results also show, with regard to cleaning, that a toner using core particles produced by grinding is more preferable than one using core particles produced by polymerization.

(Evaluative Experiment 4)

Next, using Sharp Co. copy machine AR-5030, 50,000 sheets were successively printed using each of toners T7 and T8 through T11 (to be discussed below), after which image fogging and poor cleaning were evaluated for each of these toners. Toners T8 through T11 were manufactured in the same manner as toner T7, except that, in the fine particle affixing step, PMMA particles differing from the PMMA particles C2 only in average particle diameter were used instead of the PMMA particles C2.

The original used in copying had a ratio of black of 6%. Table 22 shows the quantity of charging, average PMMA particle diameter, and the results of the above-mentioned evaluations for each toner. Here, the methods of making the evaluations in the Table are the same as in Evaluative Experiment 1 above.

TABLE 22

| TONER EVALUATED | AVERAGE PMMA PARTICLE DIAMETER [μm] | QUANTITY OF CHARGING [μc/g] | EVALUATION AFTER 50,000 COPIES | |
|---|---|---|---|---|
| | | | IMAGE FOGGING | POOR CLEANING |
| T8 | 0.05 | 18.2 | ○ | ○ |
| T9 | 0.1 | 17.0 | ○ | ○ |
| T7 | 0.2 | 15.2 | ○ | ○ |
| T10 | 0.5 | 13.9 | ○ | ○ |
| T11 | 1.0 | 12.2 | X | ○ |

IMAGE FOGGING EVALUATION: ○: GOOD Δ: SOME FOGGING, BUT WITHIN ACCEPTABLE LIMITS X: POOR
POOR CLEANING EVALUATION: ○: NO POOR CLEANING X: POOR CLEANING

As shown in Table 22, with T11, in which the average PMMA particle diameter was 1.0 μm, image fogging occurred due to peeling and separation of the PMMA particles from the core particles.

The foregoing results confirm that PMMA particles with an average particle diameter of 0.5 μm or less, i.e., no more than 1/20 of the average particle diameter of the core particles, are preferable.

(Evaluative Experiment 5)

In the present evaluative experiment, using Sharp Co. copy machine AR-5030, 50,000 sheets were successively printed using each of toners T7 and T12 through T16 (to be discussed below), after which image fogging and poor cleaning were evaluated for each of these toners. Toners T12 through T16 were manufactured in the same manner as toner T7, except that, in the fine particle affixing step, PMMA particles differing from the PMMA particles C2 only in glass transition point $T_g$ were used instead of the PMMA particles C2. The original used in copying had a ratio of black of 6%.

Further, in the present evaluative experiment, high-temperature preservation was also evaluated. This was done by filling 150 g bottles with each of the toners T7 and T12 through T16, letting stand in a 50° C. temperature environment for 48 hours, cooling by letting stand at normal temperature for 12 hours, and then evaluating the extent of aggregation of each toner. The extent of aggregation was evaluated by sifting each toner using a mesh with apertures of 150 μm.

Table 23 shows the glass transition point $T_g$ and the weight-average molecular weight of the PMMA particles in each toner, and the results of the above-mentioned evaluations for each toner. Here, the methods of making the evaluations for image fogging and poor cleaning are the same as in Evaluative Experiment 1 above. With regard to the evaluation of high-temperature preservation, "○" indicates a good evaluation, "Δ" indicates that there was some aggregation, but within acceptable limits for use, and "X" indicates a poor evaluation.

TABLE 23

| | PMMA PARTICLES | | | EVALUATION AFTER 50,000 COPIES | |
|---|---|---|---|---|---|
| TONER EVALUATED | GLASS TRANSITION POINT $T_g$ [° C.] | WEIGHT-AV. MOLECULAR WEIGHT $M_w$ | HIGH-TEMPERATURE PRESERVATION | IMAGE FOGGING | POOR CLEANING |
| T12 | 120 | 140,000 | ○ | Δ | ○ |
| T13 | 100 | | ○ | ○ | ○ |
| T14 | 85 | | ○ | ○ | ○ |
| T7 | 70 | | ○ | ○ | ○ |
| T15 | 55 | | ○ | ○ | ○ |
| T16 | 50 | | X | ○ | ○ |

IMAGE FOGGING EVALUATION: ○: GOOD Δ: SOME FOGGING, BUT WITHIN ACCEPTABLE LIMITS X: POOR
POOR CLEANING EVALUATION: ○: NO POOR CLEANING X: POOR CLEANING
HIGH-TEMPERATURE PRESERVATION EVALUATON: ○: GOOD Δ: SOME AGGREGATION, BUT WITHIN ACCEPTABLE LIMITS X: POOR

As shown in Table 23, some image fogging occurred with toner T12, whose PMMA particles had a glass transition point $T_g$ of 120° C. Further, toner T16, whose PMMA particles had a glass transition point $T_g$ of 50° C., had a poor result with regard to high-temperature preservation.

The foregoing results confirm that PMMA particles with a glass transition point $T_g$ within a range from 55° C. to 100° C. are preferable.

(Evaluative Experiment 6)

In the present evaluative experiment, using Sharp Co. copy machine AR-5030, 50,000 sheets were successively printed using each of toners T7 and T17 through T19 (to be discussed below), after which image fogging and poor cleaning were evaluated for each of these toners. Toners T17 through T19 were manufactured in the same manner as toner T7, except that, in the fine particle affixing step, PMMA particles differing from the PMMA particles C2 only in weight-average molecular weight $M_w$ were used instead of the PMMA particles C2.

The original used in copying had a ratio of black of 6%. In addition, in order to evaluate fixing on the paper surface, an original with a ratio of black of 100% was copied using each of the toners, after which a folding test for fixing was conducted. Table 24 shows the glass transition point $T_g$ and the weight-average molecular weight of the PMMA particles in each toner, and the results of the above-mentioned evaluations for each toner.

Here, the methods of making the evaluations for image fogging and poor cleaning are the same as in Evaluative Experiment 1 above. With regard to evaluation in the folding test for fixing, "○" indicates a good evaluation, "Δ" indicates that there was some peeling at the fold, but within acceptable limits for use, and "X" indicates a poor evaluation.

TABLE 24

| | PMMA PARTICLES | | | EVALUATION AFTER 50,000 COPIES | |
|---|---|---|---|---|---|
| TONER EVALUATED | GLASS TRANSITION POINT $T_g$ [° C.] | WEIGHT-AV. MOLECULAR WEIGHT $M_w$ | FOLDING TEST FOR FIXING | IMAGE FOGGING | POOR CLEANING |
| T17 | 70 | 50,000 | ○ | ○ | ○ |
| T7 | | 140,000 | ○ | ○ | ○ |
| T18 | | 200,000 | ○ | ○ | ○ |
| T19 | | 250,000 | Δ | ○ | ○ |

IMAGE FOGGING EVALUATION: ○: GOOD Δ: SOME FOGGING, BUT WITHIN ACCEPTABLE LIMITS X: POOR
POOR CLEANING EVALUATION: ○: NO POOR CLEANING X: POOR CLEANING
FOLDING TEST FOR FIXING EVALUATION: ○: GOOD Δ: SOME PEELING AT FOLD, BUT WITHIN ACCEPTABLE LIMITS X: POOR

As shown in Table 24, some peeling due to insufficient fixing to the paper occurred with toner T19, whose PMMA particles had a weight-average molecular weight $M_w$ of 250,000. However, this peeling was within acceptable limits for actual use.

The foregoing results confirm that PMMA particles with a weight-average molecular weight $M_w$ of no more than 200,000 are preferable.

As discussed above, one method of manufacturing electrophotographic toner according to the present embodiment includes the steps of (a) producing core particles for electrophotographic toner; and (b) using dry processing to attach fine particles to the surface of the core particles, and then to affix or form the fine particles into a film thereon; in which electrophotographic toners with different properties may be prepared by producing core particles of a common composition and by means of a common process, but changing the type or composition of the fine particles.

With the foregoing method, even when manufacturing different types of electrophotographic toners, a single production line for the core particles is sufficient, after which the fine particle affixing step may be performed by means of simple dry processing. Accordingly, there is no need to provide separate electrophotographic toner production lines for electrophotographic toners with different properties. Accordingly, investment in facilities may be reduced.

Further, (since the fine particle affixing step is simple dry processing, there is little contamination of the interior of the manufacturing device. Accordingly, even when manufacturing different types of electrophotographic toner on the same electrophotographic toner production line, thorough maintenance cleaning in order to remove previously manufactured electrophotographic toner remaining is not necessary. In addition, the quantity of electrophotographic toner discarded at the time of cleaning can be reduced to a minimum. Accordingly, manufacturing costs of the electrophotographic toner can also be reduced.

A second method of manufacturing electrophotographic toner according to the present embodiment is a method like the first method above, in which the core particles produced in the core particle producing step are produced by grinding.

With the foregoing method, since the core particles are produced by grinding, costs are lower than if polymerization is used. Further, core particles produced by grinding are generally irregularly shaped. Accordingly, by controlling the state of affixing of the fine particles in the fine particle affixing step, the shape of the toner particles produced can be controlled within a wide range from irregularly shaped through spherical. By this means, different electrophotographic toners having particle shapes corresponding with desired characteristics can be produced in the fine particle affixing step, without needing to produce differently-shaped core particles in the core particle producing step.

A third method of manufacturing electrophotographic toner according to the present embodiment is a method like the first method above, in which the fine particle affixing step includes a step for uniformly dispersing and attaching the fine particles to the surface of the core particles, and a subsequent step for affixing or forming the fine particles into a film.

With the foregoing method, since the step for uniformly distributing and attaching the fine particles and the step for affixing or forming them into a film are performed separately, each can be carried out with certainty. In other words, if a surface modification device of the high-energy-applying type is used to firmly attach the fine particles to the surface of the core particles, the fine particles become affixed before they are uniformly distributed. This leads to problems such as lack of uniform coverage of the surface of the electrophotographic toner particles produced by the fine particles. However, these problems can be avoided by using the foregoing manufacturing method.

A fourth method of manufacturing electrophotographic toner according to the present embodiment is a method like the third method above, in which the step for affixing or forming a film of the fine particles is performed by means of heat processing.

With the foregoing method, since the fine particles and core particles are heat fused, the fine particles can be affixed more strongly.

Further, in electrophotographic toner produced by using, for example, mechanical impact force to affix the fine particles, it is difficult to take full advantage of the properties of the fine particles. This results from, for example, embedding of the fine particles in the core particles and alteration of the shape of pointed areas on the surface of the core particles, thus covering the fine particles. Accordingly, in this case, in order to take full advantage of desired properties, a large quantity of fine particles becomes necessary, leading to the problem of increased costs. However, this problem can be avoided by using the foregoing manufacturing method.

A fifth method of manufacturing electrophotographic toner according to the present embodiment is a method like the third method above, in which, in the step for affixing or forming a film of the fine particles, heat processing is performed for a duration necessary to affix or form a film, of the fine particles, immediately after which the electrophotographic toner particles obtained thereby are cooled.

With the foregoing method, since the core particles and fine particles are strongly fused by heat processing, and the electrophotographic toner particles produced thereby are cooled immediately thereafter, aggregation due to mutual fusing of the electrophotographic toner particles, bleeding phenomenon, etc. can be held to a minimum. Bleeding phenomenon is change in particles of electrophotographic toner due, for example, to movement of low-melting-point substances like mold-release agent (wax, etc.). By avoiding aggregation, bleeding, etc., an electrophotographic toner can be provided which is free of defects, and which has uniform quality.

An electrophotographic toner according to the present embodiment is produced by means of either of the fourth or fifth manufacturing methods above, in which the fine particles are thermoplastic organic fine particles which serve as charge control agent.

With the foregoing structure, since the fine particles are affixed by means of heating, the thermoplastic organic fine particles fuse with the binder resin forming the core particles. Accordingly, the bonding of the fine particles and the core particles is stronger, and peeling or separation of the fine particles from the core particles is less likely. If inorganic fine particles are used as charge control agent, problems arise, such as embedding of these inorganic fine particles in the core particles due to stress in the developing vessel of the copy machine. However, this problem does not arise with the foregoing structure. Accordingly, problems such as image fogging due to decrease in the quantity of charging are less likely.

Further, in the electrophotographic toner according to the present embodiment, it is preferable if the fine particles have an average particle diameter which is no more than 1/20 that of the core particles. By this means, problems such as image fogging, caused by separation, etc. of insufficiently affixed fine particles, and filming phenomenon, caused by the attachment of these separated fine particles to the developing drum, can be avoided.

Further, in the electrophotographic toner according to the present embodiment, it is preferable if the fine particles have a glass transition point of from 55° C. to 100° C. By this means, problems such as aggregation of toner particles in storage, caused by impairment of storage stability, and separation of the fine particles and core particles, caused by insufficient fusing therebetween, will not occur. Accordingly, problems such as image fogging can be avoided.

Further, in the electrophotographic toner according to the present embodiment, it is preferable if the weight-average molecular weight of the fine particles is 200,000 or less. By this means, problems such as separation or peeling of the toner from the paper, due to insufficiently strong fixing of the toner to the paper, can be avoided.

The embodiments, concrete examples, and evaluative examples of implementation discussed in the foregoing detailed explanations of the present invention serve solely to illustrate the technical details of the present invention, which should not be narrowly interpreted within the limits of such examples, but rather may be applied in many variations without departing from the spirit of the present invention and the scope of the patent claims set forth below.

What is claimed is:

1. A method of manufacturing electrophotographic toner comprising the steps of:

(a) attaching and dispersing surface-modifying fine particles on the surfaces of irregularly-shaped core particles chiefly comprising binder resin, so as to produce combined particles; and (b) affixing or forming a film of the surface-modifying fine particles on the surfaces of the core particles, so as to produce electrophotographic toner particles; wherein:

the electrophotographic toner particles are manufactured so that the BET specific surface area thereof, based on $N_2$ adsorption, satisfies:

$$0.64S_0>S>1.07\times[3/(\rho D/2)]; \text{ and}$$

$$S_0=S_1X+S_2(1-X,$$

where:

S is the BET specific surface area of the toner particles;

$S_0$ is a BET specific surface area of the core particles and the surface-modifying fine particles combined together;

$S_1$ is a BET specific surface area of the core particles alone;

$S_2$ is a BET specific surface area of the surface-modifying fine particles alone;

ρ is a specific gravity of the electrophotographic toner particles;

D is an average particle diameter by volume of the electrophotographic toner particles; and X is a ratio of composition of the surface-modifying fine particles based on a weight standard.

2. The method of manufacturing electrophotographic toner set forth in claim 1, wherein:

in said step (b), the combined particles are exposed to a hot air flow area, such that a temperature applied to the surface-modifying fine particles and to the surfaces of the core particles is at or above softening points of the respective particles, but a temperature applied to the interiors of the core particles is insufficient to soften the core particles, and the combined particles are then cooled.

3. The method of manufacturing electrophotographic toner set forth in claim 2, wherein:

the hot air flow area has a temperature of more than 100° C., but less than 450° C., and the combined particles are exposed to the hot air flow for no longer than 1 second.

4. An electrophotographic toner made up of core particles which include a binder resin, and fine polymer particles affixed or made into a film on the surfaces of said core particles, wherein:

said fine polymer particles have a weight-average molecular weight within a range from 30,000 through 800,000;

said fine polymer particles have a glass transition point which is higher than that of said core particles;

said core particles have a glass transition point within a range from 40° C. through 65° C., and said fine polymer particles have a glass transition point within a range from 58° C. through 100° C.; and the electrophotographic toner is obtained by dispersing and attaching said fine polymer particles on the surfaces of said core particles, followed by heat processing by exposure to a hot air flow whose temperature is within a range from 150° C. through 400° C.

5. The electrophotographic toner set forth in claim 4, wherein:

said fine polymer particles have a weight-average molecular weight within a range from 50,000 through 200,000.

6. The electrophotographic toner set forth in claim 4, wherein:

said fine polymer particles are obtained by polymerization of at least one monomer selected from the group consisting of acrylic alkylesters, methacrylic alkylesters, styrene, and alkyl substituted styrenes.

7. The electrophotographic toner set forth in claim 4, wherein:

said fine polymer particles are obtained by polymerization of at least one monomer selected from the group consisting of acrylic alkylesters with no more than 4 carbon atoms in the alkyl group, methacrylic alkylesters with no more than 4 carbon atoms in the alkyl group, styrene, and alkyl substituted styrenes with no more than 4 carbon atoms in the alkyl group.

8. The electrophotographic toner set forth in claim 4, wherein:

an absolute value of a difference between a solubility parameter value of said fine polymer particles and a solubility parameter value of the binder resin of said core particles is not more than 2.0.

9. The electrophotographic toner set forth in claim 4, wherein:

said fine polymer particles are chargeable either positively or negatively.

10. The electrophotographic toner set forth in claim 4, wherein:

said fine polymer particles have an average particle diameter by volume which is within a range from 0.05 μm through 5.0 μm.

11. The electrophotographic toner set forth in claim 4, wherein:

said fine polymer particles have an average particle diameter by volume which is within a range from 0.05 μm through 1.0 μm.

12. The electrophotographic toner set forth in claim 4, wherein:

said fine polymer particles have an average particle diameter by volume which is not more than ⅕ of that of said core particles.

13. The electrophotographic toner set forth in claim 4, wherein:

said fine polymer particles have an average particle diameter by volume which is not more than 1/20 of that of said core particles.

14. The electrophotographic toner set forth in claim 4, wherein:

a quantity of said fine polymer particles added to said core particles is, by weight, 0.1 through 15 parts fine polymer particles for 100 parts core particles.

15. A method of manufacturing electrophotographic toner comprising the steps of:

(a) dispersing and attaching fine polymer particles on the surfaces of core particles which include binder resin; and (b) after dispersing and attaching the fine polymer particles on the surfaces of the core particles, performing heat processing by means of exposure to a hot air flow of 150° C. to 400° C., so as to affix or form a film of the fine polymer particles on the surfaces of the core particles; wherein:

the fine polymer particles have a weight-average molecular weight which is within a range from 30,000 through 800,000; and the fine polymer particles have a glass transition point which is higher than that of the core particles;

the core particles have a glass transition point within a range from 40° C. through 65° C., and the fine polymer particles have a glass transition point within a range from 58° C. through 100° C.

16. The method of manufacturing electrophotographic toner set forth in claim 15, wherein:

the heat processing is carried out for not longer than 1 second.

17. A method of manufacturing electrophotographic toner comprising the steps of:

(a) producing core particles for electrophotographic toner; and (b) using dry processing to attach fine particles to the surfaces of the core particles, and then to affix or form the fine particles into a film thereon by performing heat processing for a duration necessary to affix or form a film of the fine particles, immediately after which electrophotographic toner particles obtained thereby are cooled; wherein:

electrophotographic toners with different properties may be prepared by producing core particles having a common composition and by means of a common process, but changing the type or composition of the fine particles.

18. The method of manufacturing electrophotographic toner set forth in claim 17, wherein:

said step (a) is a step in which the core particles are produced by grinding.

19. The method of manufacturing electrophotographic toner set forth in claim 17, wherein said step (b) includes the steps of:

(c) uniformly dispersing and attaching the fine particles on the surfaces of the core particles, and:

(d) after said step (c), affixing or forming a film of the fine particles.

20. The method of manufacturing electrophotographic toner set forth in claim 19, wherein:

said step (d) includes heat processing.

21. An electrophotographic toner produced according to the manufacturing method comprising the steps of:

(a) producing core particles for electrophotographic toner; and (b) using dry processing to attach fine particles to the surfaces of the core particles, and then to affix or form the fine particles into a film thereon; wherein:

electrophotographic toners with different properties may be prepared by producing core particles having a common composition and by means of a common process, but changing the type or composition of the fine particles;

wherein step (b) includes the steps of:

(c) uniformly dispersing and attaching the fine particles on the surfaces of the core particles, and (d) after step (c), affixing or forming a film of the fine particles; wherein:

step (d) includes heat processing;

wherein:

the fine particles are thermoplastic organic fine particles which serve as charge control agent.

22. The electrophotographic toner set forth in claim 21, wherein:

the fine particles have an average particle diameter which is not more than 1/20 of that of the core particles.

23. The electrophotographic toner set forth in claim 21, wherein:

the fine particles have a glass transition point within a range from 55° C. through 100° C.

24. The electrophotographic toner set forth in claim 21, wherein:

the fine particles have an average molecular weight of not more than 200,000.

25. An electrophotographic toner produced according to the manufacturing method comprising the steps of:

(a) producing core particles for electrophotographic toner; and (b) using dry processing to attach fine particles to the surfaces of the core particles, and then to affix or form the fine particles into a film thereon; wherein:

electrophotographic toners with different properties may be prepared by producing core particles having a common composition and by means of a common process, but changing the type or composition of the fine particles;

wherein step (b) includes the steps of:

(c) uniformly dispersing and attaching the fine particles on the surfaces of the core particles, and (d) after step (c), affixing or forming a film of the fine particles; wherein:

step (d) includes heat processing for a duration necessary to affix or form a film of the fine particles, immediately after which electrophotographic toner particles obtained thereby are cooled;

wherein:

the fine particles are thermoplastic organic fine particles which serve as charge control agent.

26. The electrophotographic toner set forth in claim 25, wherein:

the fine particles have an average particle diameter of not more than 1/20 of that of the core particles.

27. The electrophotographic toner set forth in claim 25, wherein:

the fine particles have a glass transition point within a range from 55° C. through 100° C.

28. The electrophotographic toner set forth in claim 25, wherein:

the fine particles have an average molecular weight of not more than 200,000.

29. A method of manufacturing electrophotographic toner according to claim 17; wherein the electrophotographic toner particles obtained by step (b) are cooled by cooled air.

* * * * *